US005663609A

United States Patent [19]

Kamohara et al.

[11] Patent Number: 5,663,609

[45] Date of Patent: Sep. 2, 1997

[54] ELECTRON GUN ASSEMBLY HAVING A QUADRUPLE LENS FOR A COLOR CATHODE RAY TUBE

[75] Inventors: Eiji Kamohara; Junichi Kimiya, both of Fukaya, Japan

[73] Assignee: Kabushiki Kaisha Toshiba, Kawasaki, Japan

[21] Appl. No.: 530,731

[22] Filed: Sep. 19, 1995

Related U.S. Application Data

[63] Continuation of Ser. No. 45,058, Apr. 9, 1993, abandoned.

[30] Foreign Application Priority Data

Apr. 10, 1992 [JP] Japan ..... 4-089170

[51] Int. Cl.[6] ..... H01J 29/58

[52] U.S. Cl. ..... 313/412; 313/413; 315/15; 315/382

[58] Field of Search ..... 313/412, 413, 313/414, 449, 460; 315/382, 15, 14, 16

[56] References Cited

U.S. PATENT DOCUMENTS

| | | | |
|---|---|---|---|
| 4,786,845 | 11/1988 | Kato et al. | 315/15 |
| 5,061,881 | 10/1991 | Suzuki et al. | 315/15 |
| 5,157,301 | 10/1992 | Tominaga et al. | 313/412 |
| 5,241,237 | 8/1993 | Misono et al. | 315/15 |
| 5,341,070 | 8/1994 | Son | 313/414 |
| 5,367,230 | 11/1994 | Iguchi et al. | 313/414 |

FOREIGN PATENT DOCUMENTS

| | | |
|---|---|---|
| 57-31784 | 7/1982 | Japan . |
| 57-187845 | 11/1982 | Japan . |

*Primary Examiner*—Sandra L. O'Shea
*Assistant Examiner*—Matthew J. Esserman
*Attorney, Agent, or Firm*—Cushman Darby & Cushman, IP Group of Pillsbury Madison & Sutro, LLP

[57] ABSTRACT

A color cathode ray tube apparatus is provided with an electron gun assembly. In the electron gun assembly, three electron beams, which are emitted from cathodes of an in-line arrangement, are accelerated and converged onto a phosphor screen by an electron lens system of the electron gun assembly. The electron lens system is constituted by a plurality of grid electrodes and includes individual electron lenses and a common electron lens. Each of the individual electron lenses has first and second lens powers in horizontal and vertical planes, respectively. Each of the electron beams is diverged in the horizontal plane and converged in the vertical plane by the corresponding individual electron lens due to the first and second lens powers. The common electron lens has third and forth lens powers in the horizontal and vertical planes, respectively. The electron beams from the individual electron lenses are converged in the horizontal plane by the common electron lens due to the third lens power and each of the electron beams diverged by the common electron lens due to the fourth lens power.

8 Claims, 13 Drawing Sheets

ELECTRON GUN ASSEMBLY HAVING A QUADRUPLE LENS FOR A COLOR CATHODE RAY TUBE

This is a continuation of application Ser. No. 08/045,058, filed on Apr. 9, 1993, which was abandoned upon the filing hereof.

BACKGROUND OF THE INVENTION

1. Field of the Invention

The present invention relates to a color cathode ray tube in which three electron beams of an in-line arrangement passing on the same plane are emitted and, more particularly to a color cathode ray tube in which the three electron beams of an in-line arrangement are preferably focused and converged on a phosphor screen.

2. Description of the Related Art

In general, a color cathode ray tube has an envelope constituted by a panel and a funnel integrally connected to the panel. A phosphor screen constituted by three phosphor layers for emitting blue, green, and red light rays is formed on the inner surface of the panel, and a shadow mask having a plurality of apertures is formed inside the phosphor screen to be opposite to the phosphor screen. An electron gun assembly for emitting three electron beams is sealed in a neck of the funnel. The three electron beams are deflected by horizontal and vertical deflection magnetic fields generated by a deflection apparatus arranged outside the funnel, and the three electron beams are incident on the phosphor screen through the shadow mask, thereby displaying a color image.

An example of an electron gun assembly for the in-line color cathode ray tube is as follows. Three electron beam through-holes of an electrode arranged on the phosphor screen side form a main electron lens portion. Electron beam through-holes, through which a pair of side beams pass, are offset outside the arrangement direction of the three electron beams to a greater extent than those of an electrode arranged on the cathode side, opposite to the electrode on the screen side. Thus, the three electron beams converge. As an electron gun assembly capable of solving the problems of the above electron gun assembly, an electron gun assembly having the following arrangement is used. That is, the three electron beam through holes are coaxially formed, each of a plurality of electrodes arranged on cathodes. An annular permanent magnet for generating a quadrupole component magnetic field having both a focusing function and a diverging function is arranged on the final electrode, so that the three parallel electron beams emitted from the electron gun assembly are converged on a phosphor screen by a magnetic quadruple lens formed by the magnet in the arrangement direction of three electron beams, the diverging function is in the direction perpendicular to the arrangement direction.

According to this electron gun assembly, since the three electron beam through-holes of each of the plurality of electrodes arranged on the cathodes can be coaxially formed, the assembling accuracy of the electron gun assembly can be improved. The assembling accuracy is one of the problems of the electron gun assembly in which the electron beam through holes, through which the pair of side beams pass, are offset outside the three electron beams in the arrangement direction of the three electron beams more largely than those of an electrode opposite to the electrode arranged on the screen side. However, a high-power magnetic field is required to converge the three parallel electron beams on the phosphor screen by the quadrupole component lens formed by the annular permanent magnet. Due to the high-power magnetic field, the shapes of the beam spots are considerably distorted, thereby degrading a resultant image.

SUMMARY OF THE INVENTION

It is an object of the present invention to provide a color cathode ray tube which has an annular permanent magnet for forming a magnetic quadrupole lens having a focusing function in the arrangement direction of three electron beams of an in-line arrangement and a diverging function in the direction perpendicular to the arrangement direction, and is capable of forming beam spots having a small shape without any distortion on a phosphor screen, thereby obtaining preferable image characteristics.

According to the present invention, there is provided an electron gun assembly for generating a center electron beam and side electron beams deflected in horizontal and vertical directions and traveling toward a screen in a vacuum envelope having a tube axis, comprising:

three cathodes, of an in-line arrangement, for emitting the center electron beam and side electron beams; and an electron lens system for converging the center electron beam and side electron beams on the screen and focusing each of the electron beams, the lens system including:

individual electron lenses having a first lens power in a horizontal plane defined by the horizontal direction and the tube axis and a second lens power different from the first lens power in a vertical plane defined by the vertical direction and the tube axis, magnitudes of the first and second lens powers being changed in accordance with the deflection of the electron beams, the first lens power having a divergent lens power when electron beams are directed to the center region of the emitting means and a convergent lens power when electron beams are directed to the peripheral region of the emitting means, the second lens power having a convergent lens power when the electron beams are directed to the center region of the emitting means and a divergent lens power when the electron beams are directed to the peripheral region of the emitting means, and a common electron lens for correcting the distortion power of the astigmatism lens, having a third lens power in the horizontal plane and a fourth lens power different from the third lens power in the vertical plane, the three electron beams being focused on the screen by the first and third lens powers in the horizontal plane, the electron beams being focused on the screen by the second and fourth lens powers in the vertical plane.

According to the present invention, there is also provided a color cathode ray tube apparatus comprising:

beam generating means for generating three electron beams;

means for deflecting the three electron beams from the generating means in horizontal and vertical directions; and emitting means for emitting light rays, the emitting means having a center region and a peripheral region, and deflecting means for deflecting the three electron beams generated by said generating means in a horizontal and a vertical direction, said emitting means being scanned by the deflected electron beams, said deflecting means producing an astigmatism lens only when the electron beams are deflected to the peripheral region of the emitting means, the astigmatism lens having a distortion power for distorting the electron beams, the distorting power being changed depending on the deflection of the electron beams, the beam generating means including three cathodes, of an in-line arrangement, for respectively emitting a center electron beam and side electron beams, and an electron lens system for correcting the distortion power of the astigmatism lens by converging the center electron beam and side electron beams on the screen and focusing each of the electron beams, the lens system including individual electron lenses having a first lens power in a horizontal plane defined by the horizontal direction and a tube axis and a second lens power different from the first lens power in a vertical plane defined by the vertical direction and the tube axis, magnitudes of the first and second lens powers being changed in accordance with the deflection of the electron beams, the first lens power having a divergent lens power when electron beams are directed to the center region of the emitting means and a convergent lens power when electron beams are directed to the peripheral region of the emitting means, the second lens power having a convergent lens power when the electron beams are directed to the center region of the emitting means and a divergent lens power when the electron beams are directed to the peripheral region of the emitting means, and a common electron lens for correcting the distortion power of the astigmatism lens, having a third lens power in the horizontal plane and a fourth lens power different from the third lens power in the vertical plane, the three electron beams being focused on the screen in the vertical plane by the first and third lens powers in the horizontal plane, the electron beams being focused on the screen in the vertical plane by the second and fourth lens powers in the vertical plane. The cathode ray tube may also include main electron lenses provided for the respective electron beams, each having a main electron lens power for focusing an incident one of the three electron beams on the screen. The common lenses may be formed between the main lenses and the deflection means. The individual and common lenses may be quadrupole lenses.

There is further provided a color cathode ray tube including a phosphor screen, and an electron gun assembly, having three cathodes of an in-line arrangement and a plurality of electrodes, for controlling electrons emitted from the three cathodes, focusing the emitted electrons to form three electron beams of an in-line arrangement, and forming a plurality of electron lenses including main electron lenses for focusing the three electron beams on the phosphor screen, wherein a magnet for generating a magnetic quadrupole lens or electrodes for forming an electric quadrupole lens, which commonly acts on the three electron beams in a converging direction of the electron beams, are arranged near the electron gun assembly, and electrodes for forming electric quadrupole lenses having a lens function of a polarity opposite to that of the magnetic or electric quadrupole lens and respectively acting on the three electron beams are arranged in the electron gun assembly.

The electrodes for forming the electric quadrupole lenses respectively acting on the three electron beams are arranged to the electrodes for forming the main electron lenses.

The electric quadrupole lenses respectively acting on the three electron beams have different functions for a center beam and a pair of side beams.

As described above, a magnet is used to generate a magnetic quadruple lens and electrodes are used to form an electric quadruple lens, which commonly acts on the three electron beams in the converging direction of the electron beams of the in-line arrangement. The magnet and electrodes are arranged near the electron gun assembly. The electrodes for forming the electric quadrupole lenses have a lens function of a polarity opposite to that of the magnetic or the electric quadrupole lens, thereby acting on the three electron beams arranged in the electron gun assembly. In this case, a quadrupole lens has a function of focusing the electron beam in a given direction and a function of diverging the electron beam in the direction perpendicular to the given direction, and the aberration of the quadrupole lens in the focusing direction is small. For this reason, when two types of quadrupole lenses having different polarities are formed as described above, the electron beams can be focused while the lens aberrations in the given direction and the direction perpendicular to the given direction, as well as the sizes of beam spots on the phosphor screen, can be decreased. In addition, the focusing condition can be easily set in a combination with other electron lenses.

The three electron beams are converged on the phosphor screen using the magnetic or electric quadrupole lens which commonly act on the three electron beams. This electric quadrupole lens is combined to the electric quadrupole lenses respectively acting on the three electron beams, where each has a polarity opposite to the magnetic or electric quadrupole lens. In this manner, the sizes of beam spots on the phosphor screen can be decreased, and the beam spots having preferable shapes can be obtained.

More specifically, in this case, the electric quadrupole lenses respectively act on the three electron beams and each have a lens function of a polarity opposite to that of the magnetic or electric quadrupole lens arranged near the electron gun assembly so that they commonly act on the three electron beams as a main electron lenses. Accordingly, the astigmatism of an inclined yoke caused by dynamic focusing can effectively be corrected.

In addition, the electric quadrupole lenses respectively acting on the three electron beams have different functions for the center beam and the pair of side beams. In this case, a difference between the shapes of beam spots on the phosphor screen due to the different functions for the center beam and the pair of side beams by the magnetic or electric quadrupole lens commonly acting on the three electron beams can be corrected.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Embodiments of the present invention will be described below with reference to the accompanying drawings.

(Embodiment 1)

Figure 1:
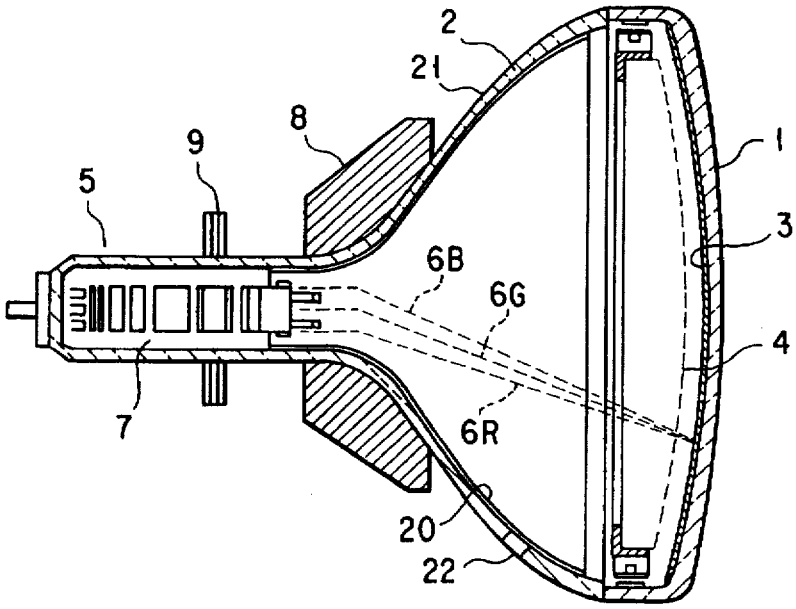
FIG. 1 is a sectional view schematically showing a color cathode ray tube apparatus according to an embodiment of the present invention.

FIG. 1 shows a color cathode ray tube according to Embodiment 1 of the present invention. The color cathode ray tube has an envelope constituted by a panel 1 and a funnel 2 integrally connected to the panel 1. A phosphor screen 3 constituted by three stripe phosphor layers for emitting blue, green, and red rays is formed on the inner surface of the panel 1, as shown in FIG. 1. A shadow mask 4 having a large number of apertures is arranged inside the phosphor screen 3 to be opposed to the phosphor screen 3. An internal conductive film 20 is formed on the inner surface of the funnel 2 and is connected to an anode electrode 22 arranged at a large-diameter portion 21 of the funnel 2. An electron gun assembly 7 for emitting three electron beams 6B, 6G, and 6R of an in-line arrangement and constituted by the center beam 6G and the pair of side beams 6B and 6R passing on the same horizontal plane (X-Z plane) is sealed in a neck 5 of the funnel 2. A deflection apparatus 8 for generating a pin-cushion-shaped horizontal deflection magnetic field and a barrel-shaped deflection magnetic field is arranged outside the boundary portion between the large-diameter portion 21 of the funnel 2 and the neck 5, and an annular permanent magnet 9 for generating two-, four-, and six-pole magnetic fields for finely adjusting the paths of the electron beams such as color purity and convergence is arranged outside the neck 5.

Figure 2A:
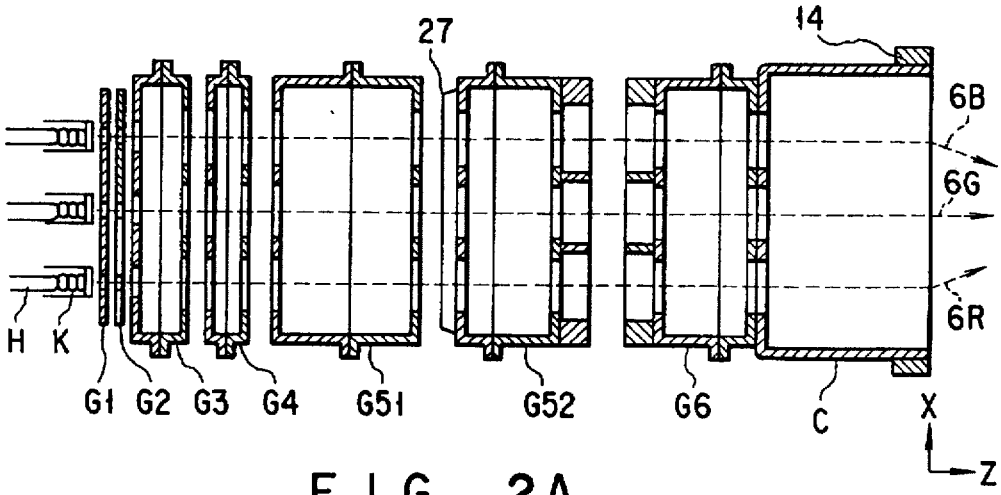
FIGS. 2A and 2B are horizontal and vertical sectional views showing the structure of the electron gun assembly of the color cathode ray tube apparatus shown in FIG. 1.
Figure 2B:
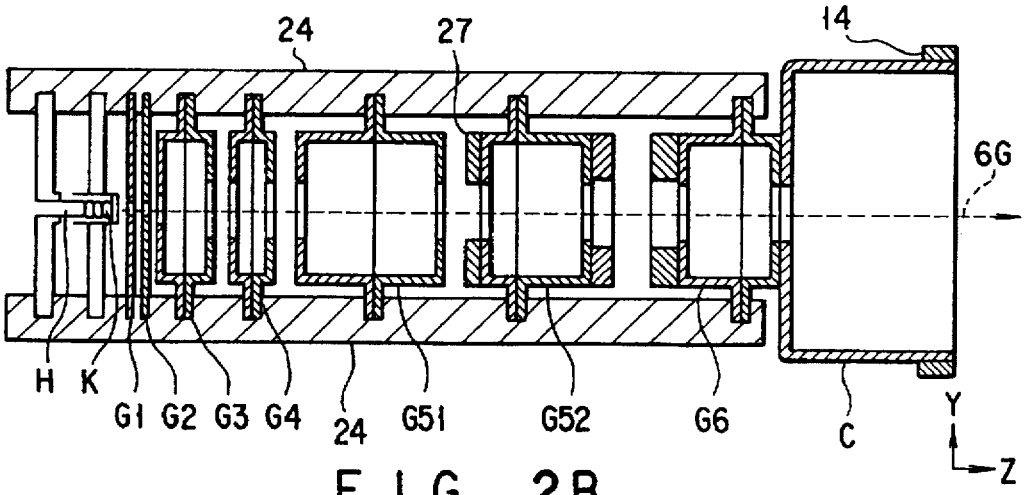

The electron gun assembly 7, as shown in FIGS. 2A and 2B, has three cathodes K of an in-line arrangement in the horizontal direction (X-axis direction), three heaters H for respectively heating the cathodes K, first, second, third, and fourth grids $G_1$, $G_2$, $G_3$, and $G_4$, fifth grids $G_{51}$ and $G_{52}$, a sixth grid $G_6$, which are sequentially arranged at predetermined intervals in a direction from the cathodes K to the phosphor screen, and a convergence cup C connected to the sixth grid $G_6$. They are integrally fixed by a pair of insulating support members 24.

Each of the first and second grids $G_1$ and $G_2$ is constituted by a thin plate electrode having an integral structure, each of the third, fourth, and fifth grids $G_3$, $G_4$, and $G_{51}$ is constituted by a cylindrical electrode having an integral structure obtained by combining two cup-like electrodes to each other, and each of the fifth and sixth grids $G_{52}$ and $G_6$ is constituted by a cylindrical electrode having an integral structure obtained by combining two cup-like electrodes to a thin plate electrode having an integral structure. Three electron beam through-holes of an in-line arrangement arranged in the horizontal direction with respect to the cathodes K are coaxially formed in each of the grids $G_1$, $G_2$, $G_3$, $G_4$, $G_{51}$, $G_{52}$, and $G_6$ and the convergence cup C. The electron beam through-holes of the first and second grids $G_1$ and $G_2$ have a relatively small size, and each of the electron beam through-holes in the end face of the third grid $G_3$ on the second grid $G_2$ side is formed to have a size larger than that of each of the electron beam through-holes of the second grid $G_2$. The electron beam through-holes of the third grid $G_3$ on the fourth grid $G_4$ and the electron beam through-holes in both the end faces of each of the fourth, fifth, and sixth grids $G_4$, $G_{51}$, $G_{52}$, and $G_6$ have a relatively large size. In addition, electron beam through-holes each having the same size as described above, are formed in the bottom portion of the convergence cup C.

Figure 3:
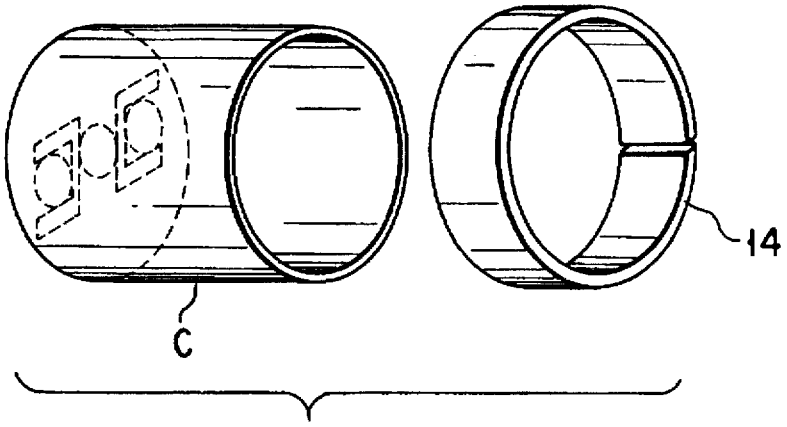
FIG. 3 is a view showing an annular permanent magnet arranged on the convergence cup of the electron gun assembly shown in FIGS. 2A and 2B to form a magnetic quadrupole lens.

In this color cathode ray tube, as shown in FIG. 3, an annular permanent magnet 14 for generating a quadrupole component magnetic field having a focusing function in an arrangement direction X of the three electron beams and a diverging function in a direction Y, where direction Y is perpendicular to the arrangement direction X of the three electron beams. Annular permanent magnet 14 is arranged on the outer surface of the convergence cup C. Although a magnetic gap is formed in the permanent magnet 14, the magnetic gap need not be formed, two or more magnetic gaps can be arbitrarily formed.

Figure 4:
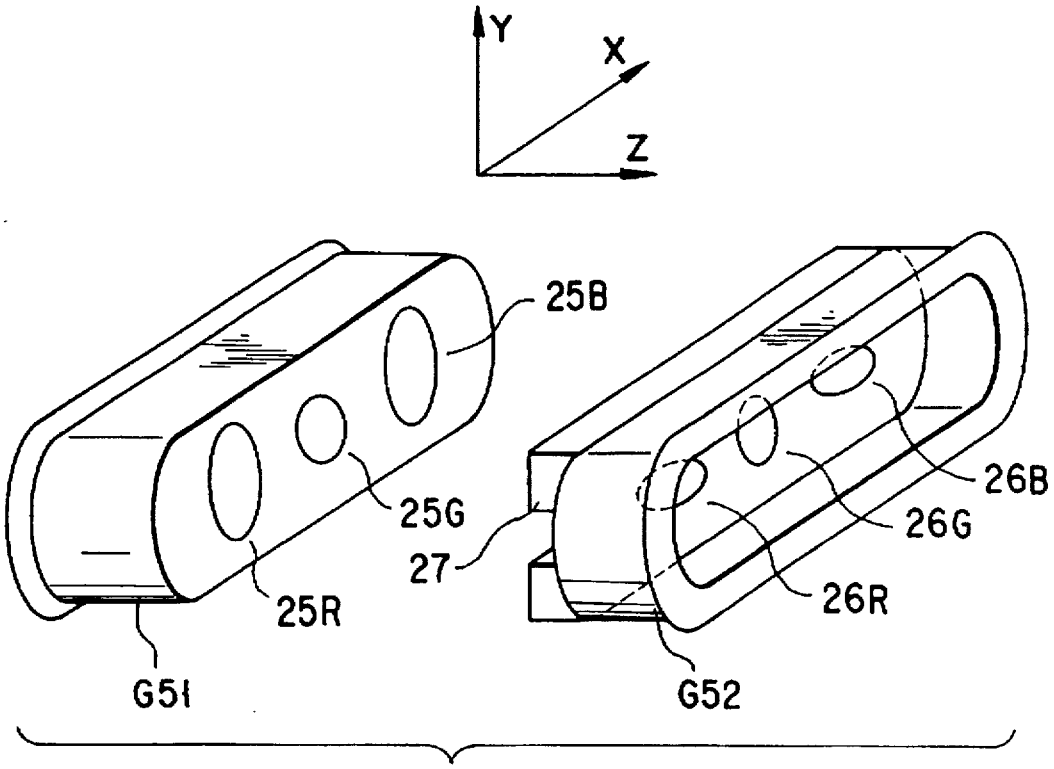
FIG. 4 is a view showing the structure of a pair of fifth grids of the electron gun assembly and the structure of parallel-plate electrodes arranged on one of the fifth grids.

In the color cathode ray tube, as shown in FIG. 4, each of a pair of side beam through-holes 25B and 25R of the fifth grid $G_{51}$ facing fifth grid $G_{52}$ has a non-circular hole having a major axis in the direction Y perpendicular to the arrangement direction X of the three electron beams 6B, 6G, and 6R. A pair of parallel-plate electrodes 27 extend in the arrangement direction X, fixed to the end face of the fifth grid $G_{52}$ which faces fifth grid $G_{51}$. The parallel-plate electrodes 27 face each other with a gap in which electron beam through-holes 26B, 26G and 26R are opened.

Figure 5:
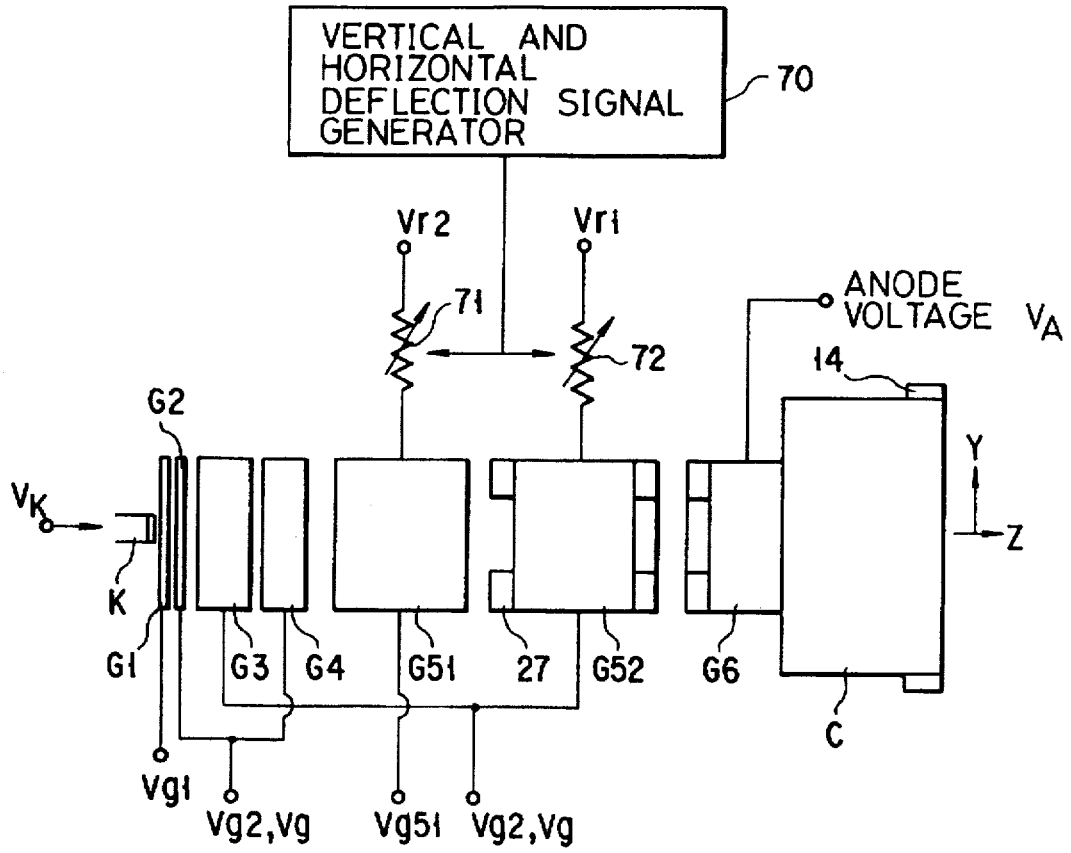
FIGS. 5 and 6 are block diagrams showing relationships between voltages applied to the grids of the electron gun assembly shown in FIGS. 2A and 2B and the connection states of the grids.
Figure 6:
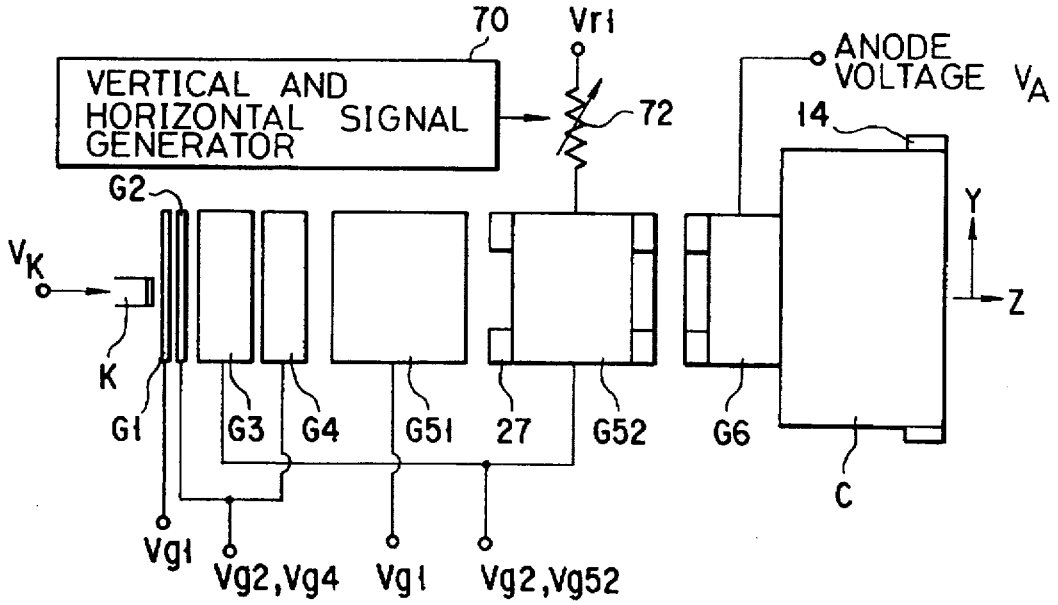

In the electron gun assembly 7, as shown in FIGS. 5 and 6, a potential $V_k$ of 100 to 200 V is applied to each of the cathodes K; a potential $V_{g1}$ of 0 V, to the first grid $G_1$; a potential $V_{g2}$ of 500 to 1,000 V, to the second grid $G_2$; a potential $V_{g3}$ of 7 to 9 kV, to the third grid $G_3$; a potential $V_{g4}$ of 500 to 1,000 V, to the fourth grid $G_4$; a potential $V_{g51}$ of 7 to 9 kV, to the fifth grid $G_{51}$; a potential $V_{g52}$ of 7 to 9 kV lower than that of the fifth grid $G_{51}$, to the fifth grid $G_{52}$; and a potential $V_A$ of 25 to 30 kV serving as an anode voltage, to the sixth grid $G_6$ and the convergence cup C. In order to change the power of an electron lens formed between the fifth grids $G_{51}$ and $G_{52}$, potentials $V_{r1}$ and $V_{r2}$ in FIG. 5 are applied to the fifth grids $G_{51}$ and $G_{52}$ through voltage converters 71 and 72, respectively. The voltage converters 71 and 72 control voltages applied to the fifth grids $G_{51}$ and $G_{52}$ in accordance with a deflection signal from a vertical and horizontal deflection signal generator 70 for generating horizontal and vertical deflection signals supplied to the deflection apparatus 8. In the circuit in FIG. 6, the potential $V_{r1}$ is applied to the fifth grid $G_{52}$ through a voltage converter 72. The voltage converter 72 controls a voltage applied to only the fifth grid $G_{52}$ in response to the deflection signal from a vertical and horizontal deflection signal generator 70 for generating the horizontal and vertical deflection signals supplied to the deflection apparatus 8. By controlling the voltages applied to the fifth grids $G_{51}$ and $G_{52}$ or the voltage applied to the fifth grid $G_{52}$, the lens power of the electron lens formed between the fifth grids $G_{51}$ and $G_{52}$ is changed.

Figure 7A:
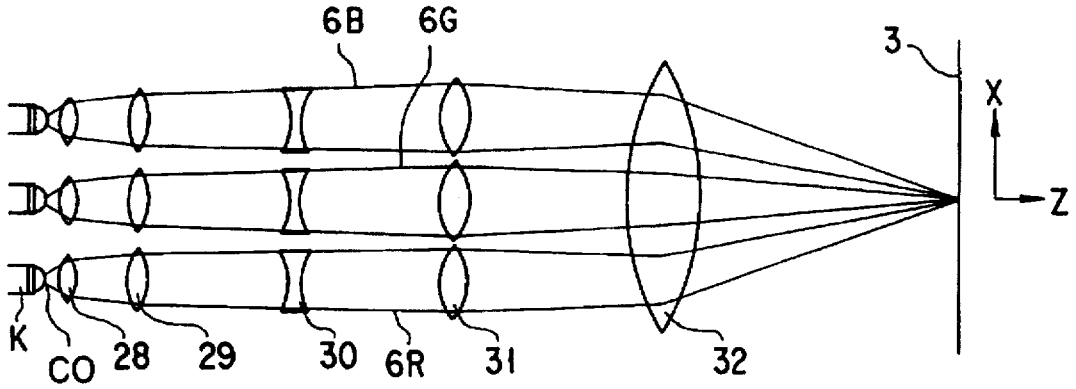
FIGS. 7A and 7B are views showing the optical mode of the electron gun assembly shown in FIGS. 2A and 2B in horizontal and vertical directions.
Figure 7B:
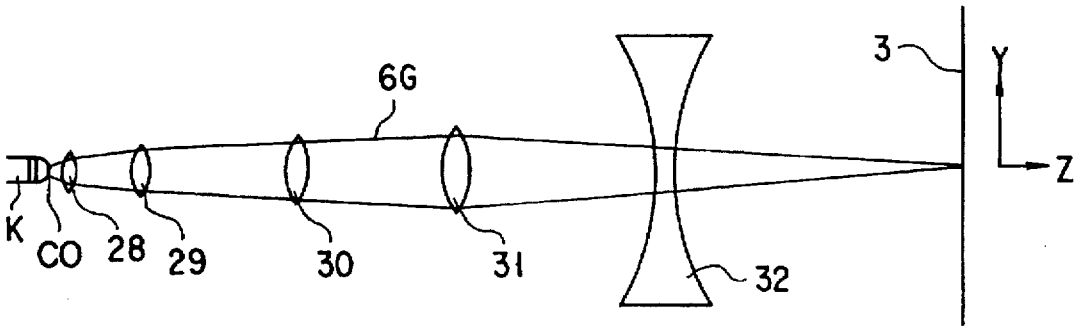

When the above potentials are applied to these electrodes, in the electron gun assembly 7, as shown in FIGS. 7A and 7B, prefocus lenses 28 are formed by the first to third grids $G_1$ to $G_3$, and sublenses 29 are formed by the third to fifth grids $G_3$ to $G_{51}$. Electric quadrupole lenses 30 (to be referred to as individual electric quadrupole lenses hereinafter) respectively acting on the three electron beams 6B, 6G, and 6R are formed by the fifth grids $G_{51}$ and $G_{52}$ and the parallel-plate electrodes 27. Main electron lenses 31 are formed by the fifth and sixth grids $G_{52}$ and $G_6$, and a magnetic quadrupole lens 32 (to be referred to as a common magnetic quadrupole lens hereinafter) commonly acting on the three electron beams 6B, 6G, and 6R is formed by the annular permanent magnet 14 arranged on the convergence cup C.

Upon forming the electron lenses, electrons discharged from each of the cathodes K to form a crossover point CO and are focused on a corresponding one of the prefocus lenses 28. Each of the three electron beams 6B, 6G, and 6R obtained by focusing the electrons is prefocused by a corresponding one of the sublenses 29 and is incident on a corresponding one of the individual electric quadrupole lenses 30. Each of the individual electric quadrupole lenses 30 has a diverging function in the plane of a tube-axis direction Z and the arrangement direction X of the three electron beams 6B, 6G, and 6R, and a focusing function in the plane of the tube-axis direction Z and the direction Y perpendicular to the arrangement direction X. The individual electric quadrupole lenses 30 diverge the three electron beams 6B, 6G, and 6R in the plane of the arrangement direction X and the tube-axis direction Z and focus the three electron beams 6B, 6G, and 6R in the plane of the tube-axis direction Z and the direction Y perpendicular to the arrangement direction X so as to guide the electron beams to the main electron lenses 31, respectively. Each of the three electron beams 6B, 6G, and 6R is focused by a corresponding one of the main electron lenses 31, and the focused three electron beams 6B, 6G, and 6R are incident on the common magnetic quadrupole lens 32. In contrast to the individual electric quadrupole lenses 30, the common magnetic quadrupole lens 32 has a focusing function in the plane of the tube-axis direction Z and the arrangement direction X of the three electron beams 6B, 6G, and 6R and a diverging function in the plane of the tube-axis direction Z and the direction Y perpendicular to the arrangement direction X. The common magnetic quadrupole lens 32 focuses the three electron beams 6B, 6G, and 6R in the plane of the tube-axis direction Z and the arrangement direction X of the three electron beams 6B, 6G, and 6R and diverges the three electron beams 6B, 6G, and 6R in the plane of the tube-axis direction Z and the direction Y perpendicular to the arrangement direction X, so that the three electron beams 6B, 6G, and 6R which are parallel to each other until the beams are incident on the common magnetic quadrupole lens 32 are focused on the phosphor screen 3.

As a result, when the electron gun assembly 7 is constituted as described above, the sizes of the beam spots on the phosphor screen 3 can be decreased, the beam spots having preferable shapes can be obtained, and the three electron beams 6B, 6G, and 6R can be converged on the phosphor screen 3. That is, assume that the individual electric quadrupole lenses 30 are not formed. Then, as described above, the three electron beams 6B, 6G, and 6R which parallelly travel on the same horizontal plane through the prefocus lenses 28, the sublenses 29, and the main electron lenses 31 would be focused on the phosphor screen 3 by the common magnetic quadrupole lens 32 formed by the annular permanent magnet 14 having the focusing function in the arrangement direction of the beams and the diverging function in the direction perpendicular to the arrangement direction. In this case, as described above and as shown in FIGS. 7A and 7B, the beam spot of the center beam 6G would be vertically distorted, and the beam spots of the pair of side beams 6B and 6R would be vertically distorted and have tails in the horizontal direction, thereby degrading an image. In contrast to this, in the electron gun assembly of this embodiment, in addition to the prefocus lenses 28, the sublenses 29, and the main electron lenses 31, individual electric quadrupole lenses 30 each having a polarity opposite to that of the common magnetic quadrupole lens 32 are provided. Thus, a diverging function in the arrangement direction of the three electron beams 6B, 6G, and 6R and a focusing function in the direction perpendicular to the arrangement direction are formed, the small lens aberration of the quadrupole lens in the focusing direction can be advantageously utilized. For this reason, when the individual electric quadrupole lenses 30 each having a polarity opposite to that of the common magnetic quadrupole lens 32 is combined to the common magnetic quadrupole lens 32, a beam spot diameter can be made smaller than that of an electron gun assembly constituted by only conventional electric-field electron lenses. In addition, the individual electric quadrupole lenses 30 respectively act on electron beams 6B, 6G, and 6R, and asymmetric lenses are used for the pair of side beams 6B and 6R, so that the shapes of the beam spots formed by the center beam 6G and the pair of side beams 6B and 6R on the phosphor screen 3 can be equal to each other.

When the individual electric quadrupole lenses 30 are arranged as described above, and the functions of the individual electric quadrupole lenses 30 for the center beam 6G and the pair of side beams 6B and 6R are changed, corrections may be performed. That is, correction can be made for not only distortion of the beam spot caused by the common magnetic quadrupole lens 32, but differences between the functions of the deflection apparatus 8 and other electron lenses for the center beam 6G and the pair of side beams 6B and 6R. Therefore, the beam spots on the phosphor screen 3 can have preferable shapes.

When the electron gun assembly 7 is arranged as described above, deflection errors caused by a non-uniform deflection magnetic field generated by the deflection apparatus 8 can be very effectively corrected.

Figure 8:
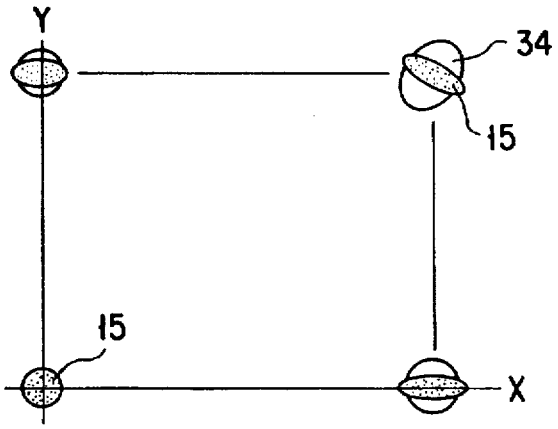
F I G. 8 (PRIOR ART)
FIG. 8 is a view for explaining the shapes of beam spots on the phosphor screen of a conventional self-convergence in-line color cathode ray tube.
Figure 9A:
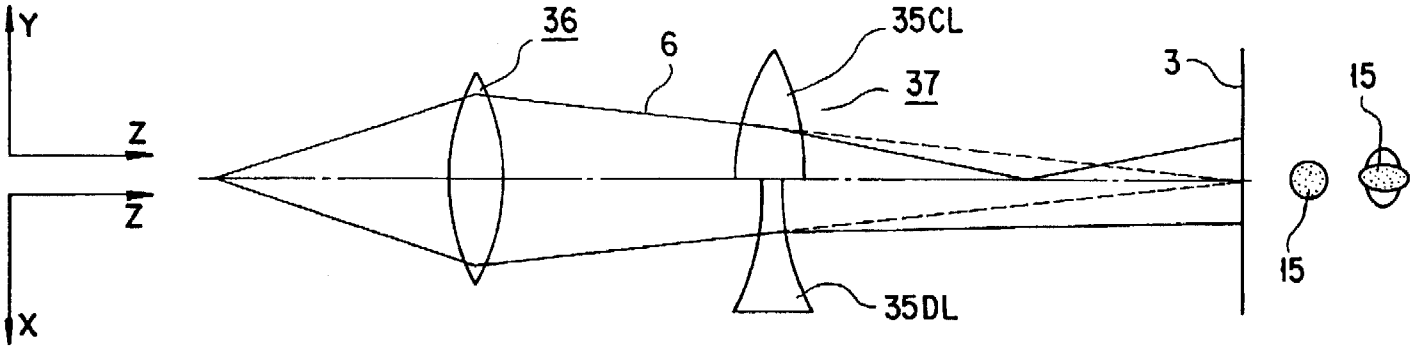
FIG. 9A (PRIOR ART)
FIG. 9A is a view showing a relationship between the shapes of beam spots of a conventional self-convergence in-line color cathode ray tube and electron lenses formed in the electron gun assembly.

In a convergence in-line color cathode ray tube, even when beam spots 15 (15B, 15G, and 15R) at the central portion of the phosphor screen have a circular shape, beam spots 15 at the peripheral portion of the phosphor screen have a horizontally elongated shape with a vertical (Y-axis direction) halo 34, and a resultant image is considerably degraded. Effects such as these which are due to the non-uniform magnetic field of the deflection apparatus 8, as shown in FIG. 8. FIG. 9A illustrates an electron lens system in a horizontal plane including the horizontal direction X and the tube-axis direction Z on the lower side with respect to the tube axis (Z axis) as the boundary, and an electron lens system in a vertical plane including the vertical direction Y and the tube-axis direction Z on the upper side with respect to the tube axis as the boundary. The magnetic field of the deflection apparatus forms a diverging lens 35DL in the horizontal direction and focusing lens 35CL in the vertical direction for the three electron beams 6B, 6G, and 6R. In order to correct the astigmatism of the deflection apparatus, as conventionally described in Published Unexamined Japanese Patent Application Nos. 64-38974, 1-232643, 3-93153, and the like, a dynamic focusing method is known in which an electron lens portion 36 of the electron gun assembly is changed in accordance with an amount of deflection of the deflection apparatus 8. According to this method, the distance between the electron lens portion 36 and a substantial astigmatism lens portion 37 of the deflection apparatus is so large that correction efficiency of the electron lens portion 36 is low.

Figure 9B:
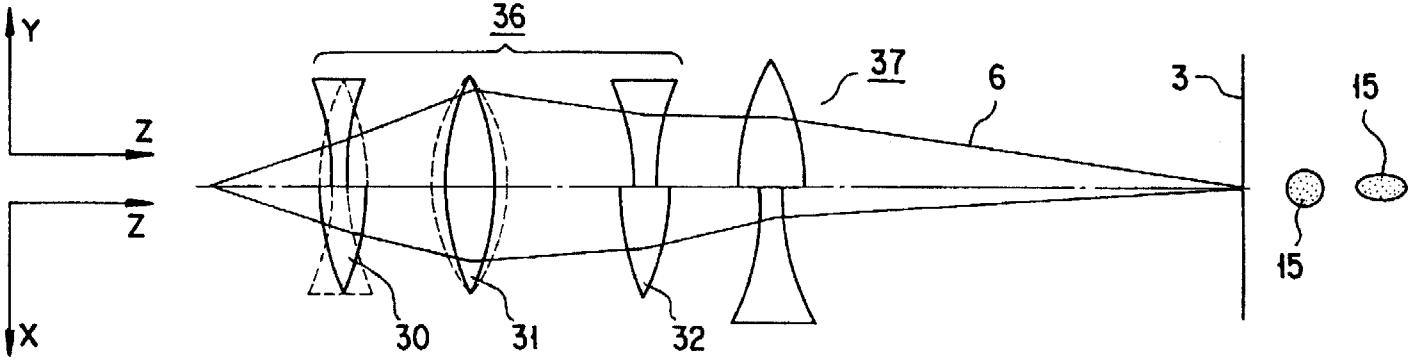
FIG. 9B is a view showing a relationship between the shapes of beam spots formed by the electron gun assembly shown in FIGS. 2A and 2B and electron lens formed in the electron gun assembly, respectively.

In contrast to this, when the electron gun assembly is arranged according to this embodiment, as illustrated in FIG. 9B, an electron lens system is shown in the horizontal plane (plane including the arrangement direction of the three electron beams) and the tube axis on the low side with respect to the tube axis as the boundary and as an electron lens system is shown in the vertical plane (plane including the tube axis and the direction perpendicular to the arrangement direction of the three electron beams) on the upper side with respect to the tube axis as the boundary. The common electric quadrupole lenses 32 each having a polarity opposite to a substantial astigmatism lens portion 37 of the deflection apparatus can be formed close to the astigmatism lens portion 37. For this reason, in the electron gun assembly in this embodiment, an effect obtained by causing the electron lens portion 36 of the conventional electron gun assembly to perform a correcting operation is enhanced by the common magnetic quadrupole lenses 32, so that the astigmatism of the deflection apparatus can be effectively reduced. The dashed lines shown with respect to lenses 30 and 31 represent changes experienced by those lenses to achieve correction through dynamic focussing. As shown, dynamic focusing can be used to change individual lenses 30 to achieve convergence or divergence in either the horizontal or vertical planes.

Figure 10A:
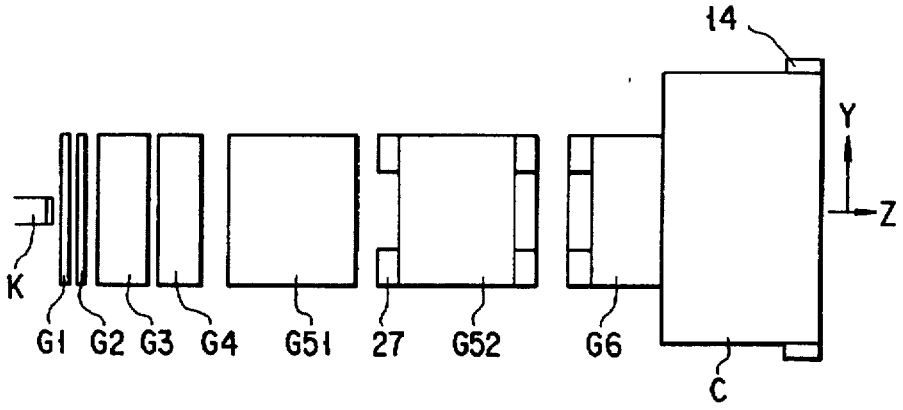
FIG. 10A is a view showing the arrangement of the electrodes of the electron gun assembly shown in FIGS. 3A and 3B.
Figure 10B:
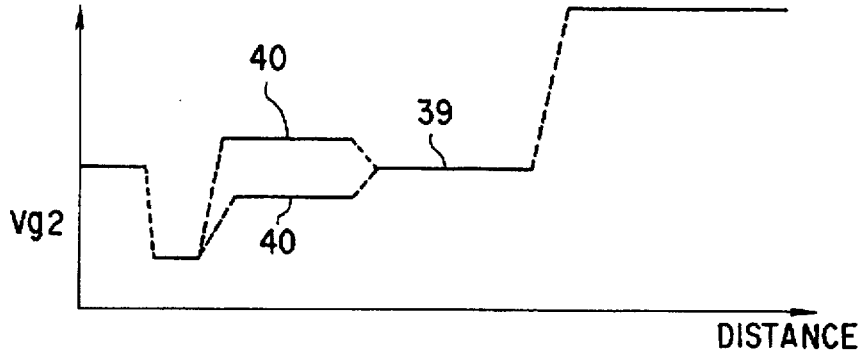
FIGS. 10B to 10D are graphs for explaining a relationship between potentials of the fifth grids in dynamic focusing and the arrangement shown in FIG. 10A.
Figure 10C:
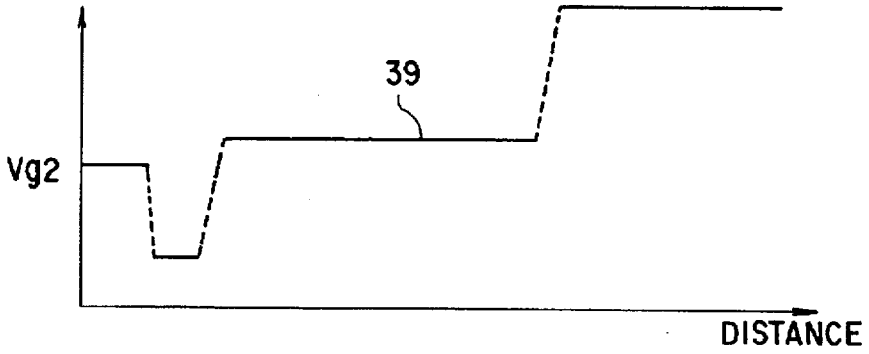
Figure 10D:
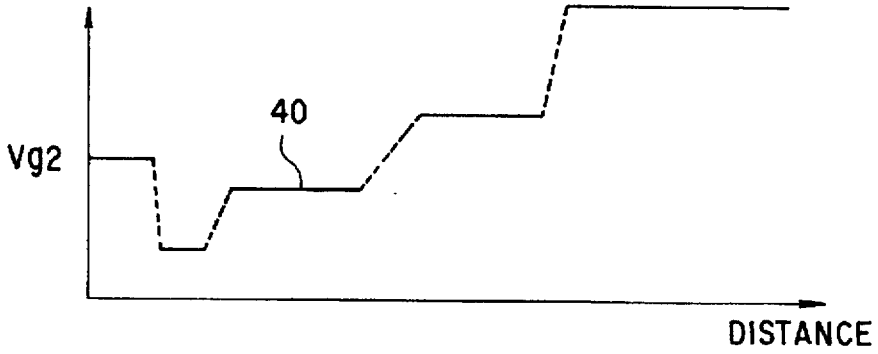

More specifically, dynamic focusing, as shown in FIGS. 5 and 6, is changed in accordance with deflection signals (one or both of horizontal deflection and vertical deflection) supplied from the vertical and horizontal deflection signal generator 70 to the deflection apparatus 8 for generating a deflection magnetic field and deflecting the electron beams. That is, as shown in FIGS. 10B and 10C showing potential distributions corresponding to the electrode arrangement shown in FIG. 10A, a potential 39 of the fifth grid $G_{52}$ is increased. In order to further effectively utilize the dynamic focusing, a potential 40 of the fifth grid $G_{51}$ may be decreased from the potential shown in FIG. 10B to the potential shown in FIG. 10D. In this manner, when the potential 40 of the fifth grid $G_{51}$ is set to be lower than the potential 39 of the fifth grid $G_{52}$, the individual electric quadrupole lenses 30 between the fifth grids $G_{51}$ and $G_{52}$ have a focusing function in the horizontal direction and a diverging function in the vertical direction. For this reason, the correction can be made for distortion of the shapes of the beam spots at the peripheral portion of the phosphor screen which are caused by the astigmatism of the deflection apparatus.

When the parallel-plate electrodes 27 are arranged on the end face of the fifth grid $G_{52}$ on the fifth grid $G_{51}$ side, as shown in FIG. 10B, the potential 40 of the fifth grid $G_{51}$ is set to be lower than the potential 39 of the fifth grid $G_{52}$.

(Embodiment 2)

In the description of Embodiment 1, the asymmetric individual electric quadrupole lenses, which respectively act on the three electron beams, have different functions for the center beam and the pair of side beams. However, depending on the types of color cathode ray tubes, the focusing states of the center beam and the pair of side beams may be almost equal to each other on the phosphor screen. That is, only when symmetric individual electric quadrupole lenses have the same functions for the center beam and the pair of side beams, or symmetric individual electric quadrupole lenses are used in which functions for the pair of side beams are slightly enhanced relative to the center beam.

Figure 11:
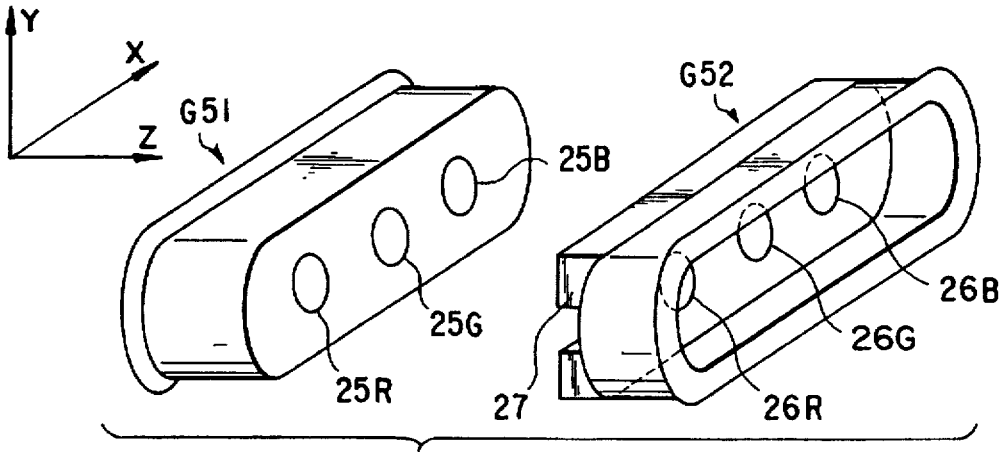
FIG. 11 is a view showing the structure of a pair of fifth grids of an electron gun assembly according to Embodiment 2 of the present invention and the structure of parallel-plate electrodes arranged on one of the fifth grids.

Such symmetric individual electric quadrupole lenses are formed as follows. That is, as shown in FIG. 11, electron beam through-holes 25B, 25G, and 25R of a fifth grid $G_{51}$ facing a fifth grid $G_{52}$ side and electron beam through-holes 26B, 26G, and 26R of the fifth grid $G_{52}$ facing the fifth grid $G_{51}$ may be formed to have a circular shape. A pair of parallel-plate electrodes 27 extend in the arrangement direction X, fixed to the end face of the fifth grid $G_{52}$ which faces grid $G_{51}$. The parallel-plate electrodes 27 face each other with a gap in which electron beam through-holes 26B, 26G and 26R are opened.

Figure 12:
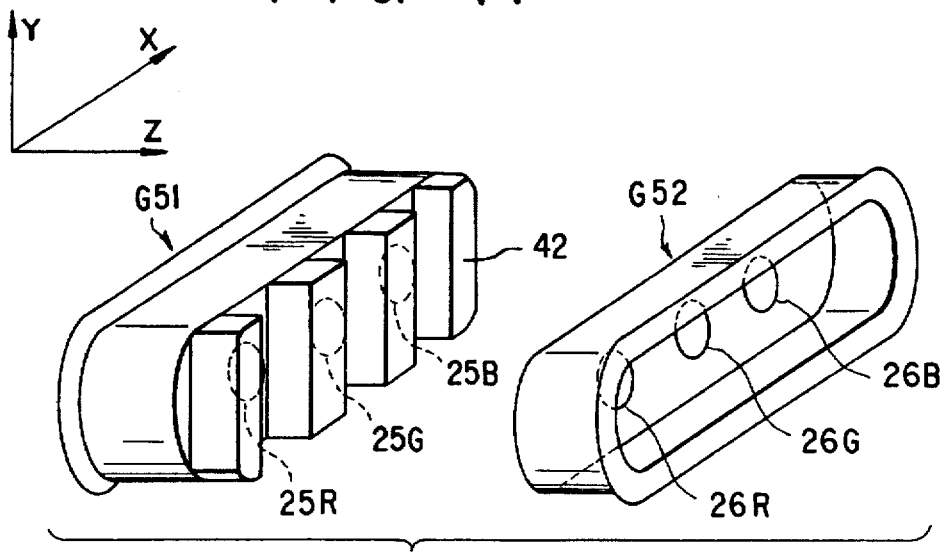
FIG. 12 is a view showing the structure of a pair of fifth grids of an electron gun assembly according to a modification of Embodiment 2 of the present invention.
Figure 13:
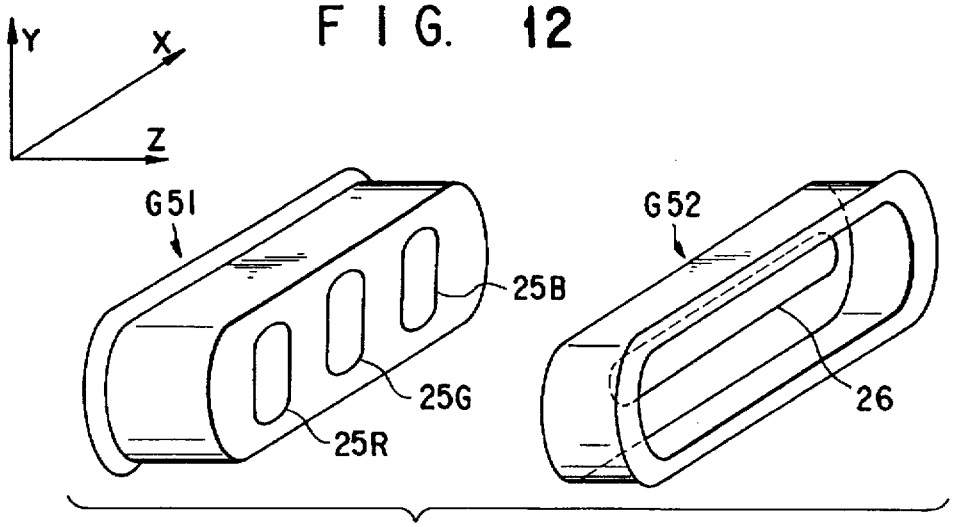
FIG. 13 is a view showing a pair of fifth grids of an electron gun assembly according to another modification of Embodiment 2 of the present invention.
Figure 14:
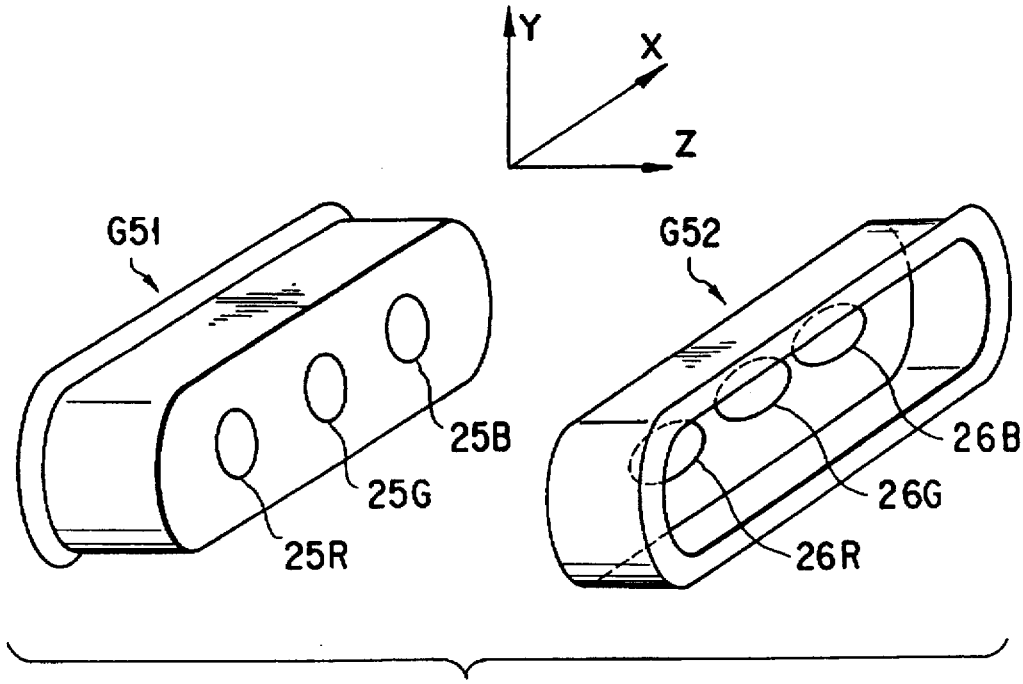
FIGS. 14 and 15 are views showing the structures of pairs of fifth grids of electron gun assemblies according to other modifications of Embodiment 2 of the present invention.
Figure 15:
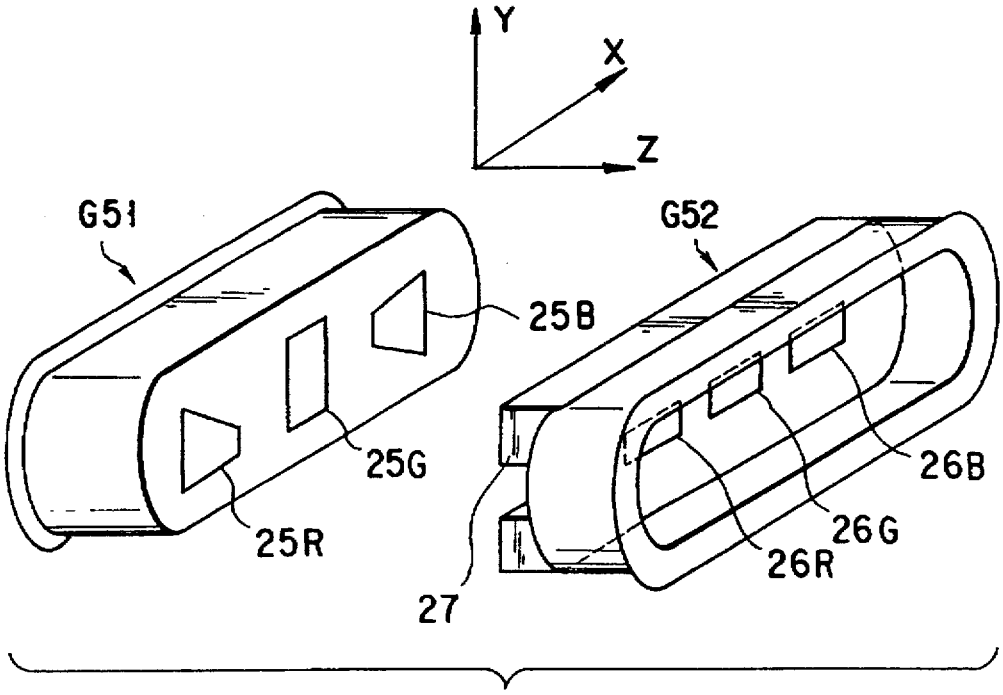

The above symmetric individual electric quadrupole lenses may be formed by the following structures. That is, as shown in FIG. 12, the electron beam through-holes 25B, 25G, and 25R of the fifth grid $G_{51}$ facing the fifth grid $G_{52}$ side and the electron beam through-holes 26B, 26G, and 26R of the fifth grid $G_{52}$ facing the fifth grid $G_{51}$ are circular holes. Parallel-plate electrodes 42 are arranged in parallel with gaps in which electron beam through-holes are opened, in a manner that each of the electrodes 42 is extended in a direction Y perpendicular to the arrangement direction X. The parallel-plate electrodes are fused to the end face of the firth grid $G_{51}$ which faces fifth grid $G_{52}$. As shown in FIG. 13, each of the electron beam through-holes 25B, 25G, and 25R of the fifth grid $G_{51}$facing the fifth grid $G_{52}$ side is a vertically elongated electron beam through-holes and an electron beam through hole of the fifth grid $G_{52}$ facing the fifth grid $G_{51}$ is one common horizontally elongated electron beam through-holes 26. As shown in FIG. 14, each of the electron beam through-holes 25B, 25G, and 25R of the fifth grid $G_{51}$ facing the fifth grid $G_{52}$ side is a circular hole, and each of the electron beam through-holes 26B, 26G, and 26R of the fifth grid $G_{52}$ on the fifth grid $G_{51}$ is a horizontally elongated electron beam through-holes. In addition, parallel-plate electrodes which interpose the three electron beam through-holes 26B, 26G, and 26R from the direction perpendicular to the arrangement direction of the electron beam through-holes may be combined to the grids arranged as described above. In order to form a substantially circular beam spot at the peripheral portion on a phosphor screen 3, the fifth grid $G_{51}$ and the fifth grid $G_{52}$ preferably have the structure shown in FIG. 15. That is, although an electron beam is distorted at the peripheral portion on the phosphor screen 3 as described above, when the grids having the above structure are employed, a substantially circular beam spot can be formed on the phosphor screen 3. However, the beam spot at the peripheral portion on the phosphor screen 3 may slightly distorted in an X direction. For this reason, as shown in FIG. 15, the electron beam through-holes 25G of the fifth grid $G_{51}$ on the fifth grid $G_{52}$ is formed to have a rectangular shape, each of the electron beam through-holes 25R and 25B is formed to have an almost trapezoidal shape, and the shorter sides of the trapezoidal shapes are opposite to each other. Each of the electron beam through-holes 26B, 26G, and 26R of the fifth grid $G_{52}$ on the fifth grid $G_{51}$ side is formed to have a rectangular shape extending in the horizontal direction, and parallel-plate electrodes 27 which interpose the electron beam through-holes 26B, 26G, and 26R of the fifth grid $G_{52}$ facing the fifth grid $G_{51}$ side from the direction parallel to the arrangement direction of the electron beam through-holes 26B, 26G, and 26R are arranged on the fifth grid $G_{52}$.

More particularly, when the individual electric quadrupole lens is to be formed in an electron gun assembly, in dynamic focusing at the central portion of the phosphor screen obtained when the parallel-plate electrodes 27 are not arranged, a potential 40*a* of the grid $G_{51}$ is set to be higher than a potential 39 of the fifth grid $G_{52}$ shown in FIG. 10B.

(Embodiment 3)

In Embodiment 1, although the annular permanent magnet for forming a common magnetic quadrupole lens is arranged on the outer surface of the convergence cup in the neck, the permanent magnet may be arranged outside the neck.

(Embodiment 4)

In Embodiment 1, although the annular permanent magnet which is magnetized in advance is arranged on the convergence cup, the permanent magnet may be obtained as follows. That is, an annular magnetic member which is not magnetized is arranged on the convergence cup, and the magnetic member is magnetized from the outside of the neck after or before the magnetic member is sealed in the neck together with an electron gun assembly.

Figure 16:
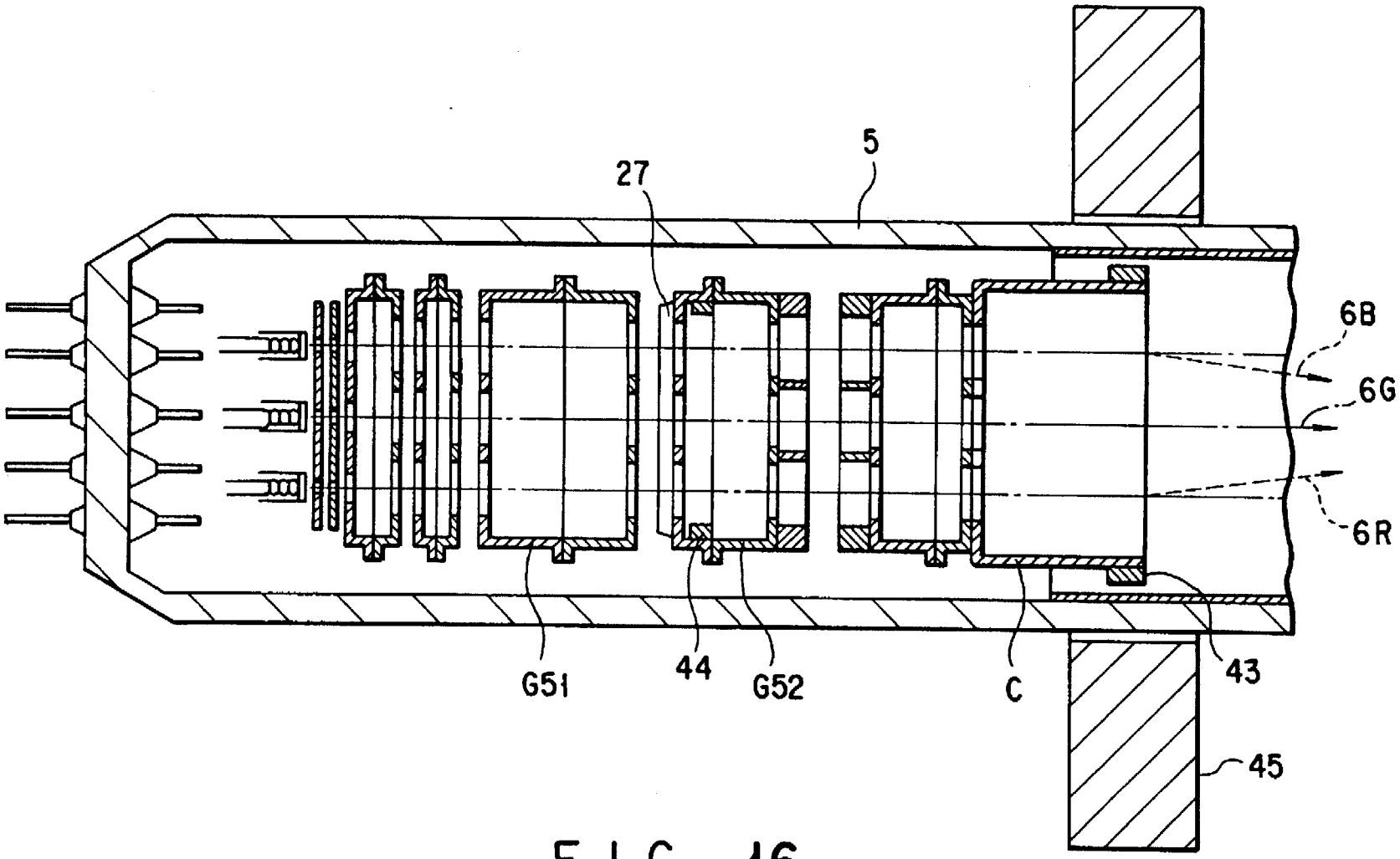
FIG. 16 is a horizontal sectional view showing the structure of an electron gun assembly according to Embodiment 4 of the present invention.

As a method of magnetizing the magnetic member sealed in the neck, by applying a technique described in Published Examined Japanese Patent Application No. 50-35769, 57-31784, 61-6966, or the like. As shown in FIG. 16, for example, an annular magnetic member 43 prospectively serving as a permanent magnet for forming a common magnetic quadrupole lens is arranged on the outer surface of a convergence cup C, and an annular magnetic member 44 prospectively serving as a multiple magnet for finely adjusting an electron beam path is arranged in a fifth grid $G_{52}$. In the steps in manufacturing a color cathode ray tube, a magnetizing unit 45 arranged outside a neck 5 at a position corresponding to the magnetic member 43 magnetizes the magnetic member 43, and three electron beams 6B, 6G, and 6R are converged in a ±2-mm circle on a phosphor screen. The magnetizing unit 45 is arranged outside the neck 5 at a position corresponding to the magnetic member 44 to magnetize the magnetic member 44, thereby obtaining an eight-pole magnet.

As a magnetic member arranged in the tube, spinodale consisting of Fe, Cr, and Co alloys or Bicalloy consisting of Fe, Cr, and V alloys is preferably used.

In the above arrangement, a permanent magnet for finely adjusting an electron beam path need not be arranged outside the neck 5. Therefore, the permanent magnet which is adjusted in advance and arranged outside a neck of a conventional color is not necessary, thereby preventing a magnetic field shifts and changes due to external environment.

In this case, when the permanent magnet for finely adjusting electron beam paths is arranged on a cathode side with respect to a permanent magnet for forming a common magnetic quadrupole lens, the converging state of the electron beams is not changed regardless of a variation in focusing voltage. However, the permanent magnet for finely adjusting the electron beam paths is arranged on the phosphor screen side, and the positions of the permanent magnet for finely adjusting the electron beam paths and the permanent magnet for forming the common magnetic quadrupole lens need not be arranged in this order. When a permanent magnet is formed by a method in which a magnetic member is arranged in a neck and the magnetic member is magnetized from the outside of the tube, the permanent magnet for finely adjusting the electron beam paths to prevent an influence of the deflection apparatus is preferably arranged on the cathode side with respect to the permanent magnet for forming the common magnetic quadrupole lens.

Figure 17:
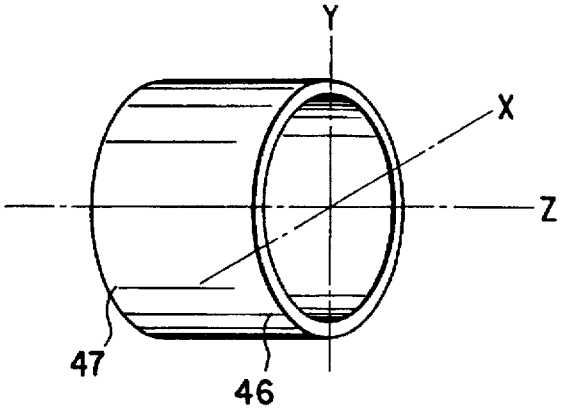
FIG. 17 is a view for explaining a magnetic quadrupole lens formed in one magnetic member and a permanent magnet for finely adjusting electron beam paths.

As described above, when the magnetic member is arranged in the neck, and the magnetic member is to be magnetized from the outside of the tube, the permanent magnet for forming the common magnetic quadrupole lens and the permanent magnet for finely adjusting the electron beam paths can be combined to each other to form one magnetic member. In this case, the production cost of the color cathode ray tube can be reduced. In this case, as shown in FIG. 17, when a four-pole magnetizing portion 46 for the permanent magnet used to form the magnetic quadrupole lens and, e.g., an eight-pole magnetizing unit 47 for the permanent magnet for finely adjusting the electron beam paths are formed to be shifted in the tube-axis direction, desired magnetic poles can be easily formed.

(Embodiment 5)

Figure 18:
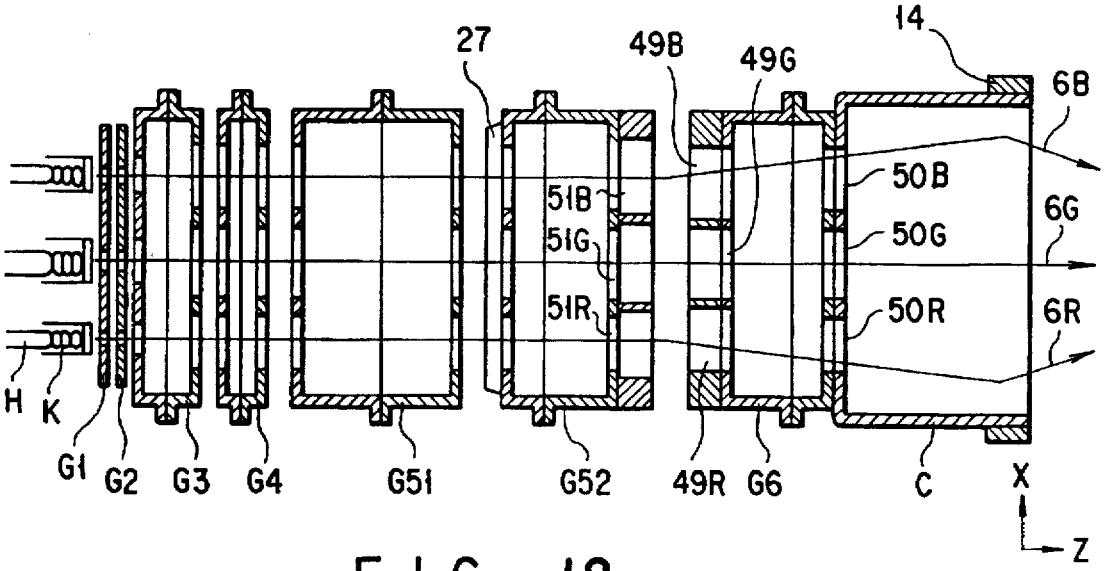
FIG. 18 is a horizontal sectional view showing the structure of an electron gun assembly according to Embodiment 5 of the present invention.

An electron gun assembly according to Embodiment 5 is shown in FIG. 18. This electron gun assembly, as in the electron gun assembly according to Embodiment 1 shown in FIGS. 2A and 2B, has three cathodes K of an in-line arrangement in a horizontal direction (X-axis direction), three heaters H for respectively heating the cathodes K, first and second grids $G_1$ and $G_2$ each constituted by a plate electrode, third to sixth grids $G_3$ to $G_6$ each constituted by a cylindrical electrode obtained by combining cup electrodes to each other and a convergence cup C arranged to the sixth grid $G_6$. These grids are sequentially arranged at predetermined intervals in a direction from the cathodes K to a phosphor screen. A permanent magnet 14 for forming a common magnetic quadrupole lens is arranged on the outer surface of the convergence cup C, and a parallel-plate electrode 27 is formed on the end face of the fifth grid $G_{52}$ on the fifth grid $G_{51}$ side. More specifically, in the electron gun assembly, electron beam through-holes are formed in the grids $G_1$ to $G_6$ and the convergence cup C with respect to the cathodes K. The electron beam through holes of the first to fifth grids $G_1$ to $G_{52}$ are coaxially formed. However, of the electron beam through-holes 49B, 49G, 49R, 50B, 50G, and 50R of the sixth grid $G_6$ and the convergence cup C, although the center beam through holes 49G and 50G are formed coaxially with the center beam through-holes of the first to fifth grids $G_1$ to $G_{52}$, the pair of side beam through holes 49B and 49R and the pair of side beam thorough holes 50B and 50R are offset to the inner side of the direction of the electron beam through-holes 49B, 49G, 49R, 50B, 50G, and 50R with respect to the pair of the side beam through-holes 51B and 51R of the fifth grid $G_{52}$ on the sixth grid $G_6$ side.

When the electron gun assembly is arranged as described above, a pair of side beams 6B and 6R which parallelly pass from the first grid $G_1$ to the fifth grid $G_{52}$ are curved to the outer sides of the arrangement direction of the three electron beams 6B, 6G, and 6R by main electron lenses formed by the fifth grid $G_{52}$ and the sixth grid $G_6$. Therefore, the power of the common magnetic quadrupole lens formed by the permanent magnet 14 is increased, and the pair of side beams 6B and 6R curved outside is largely curved toward the center beam $6_G$, so that the three electron beams must be converged on the phosphor screen. As a result, the distortions of the beam spots on the phosphor screen caused by the common magnetic quadrupole lens are considerably large, and an individual quadrupole lens formed by the parallel-plate electrode 27 to cancel the distortions must have high powers.

In the electron gun assembly, the high-power individual electric quadrupole lens is combined to the high-power common magnetic quadrupole lens, thereby considerably decreasing the size of the beam spot of each of the electron beams 6B, 6G, and 6R at the center portion of the phosphor screen. In addition, since the common magnetic quadrupole lens has a high power, an effect of canceling the astigmatism of a deflection apparatus is enhanced. Since the individual electric quadrupole lens has a high power, the sensibility of dynamic focusing function when the three electron beams 6B, 6G, and 6R are deflected to the peripheral portion of the phosphor screen is increased. Beam spots in the entire area of the phosphor screen from the center portion to the peripheral portion can be improved by slightly changing a voltage, so that image characteristics can be remarkably improved.

In this case, when focusing characteristics of the electron lens portion of the electron gun assembly are changed, the focusing states of the three electron beams 6B, 6G, and 6R are also changed. For this reason, an electron lens for correcting the change in focusing state is preferably arranged not to change the focusing state, as described in Published Unexamined Japanese Patent Application No. 55-53853.

In the above electron gun assembly, although one individual electric quadrupole lens is formed between the fifth grids $G_{51}$ and $G_{52}$, a plurality of individual electric quadrupole lenses may be formed. In addition, the lens function of the common magnetic quadrupole lens may be corrected as a whole by combining individual electric quadrupole lenses having different polarities to each other.

(Embodiment 6)

Figure 19A:
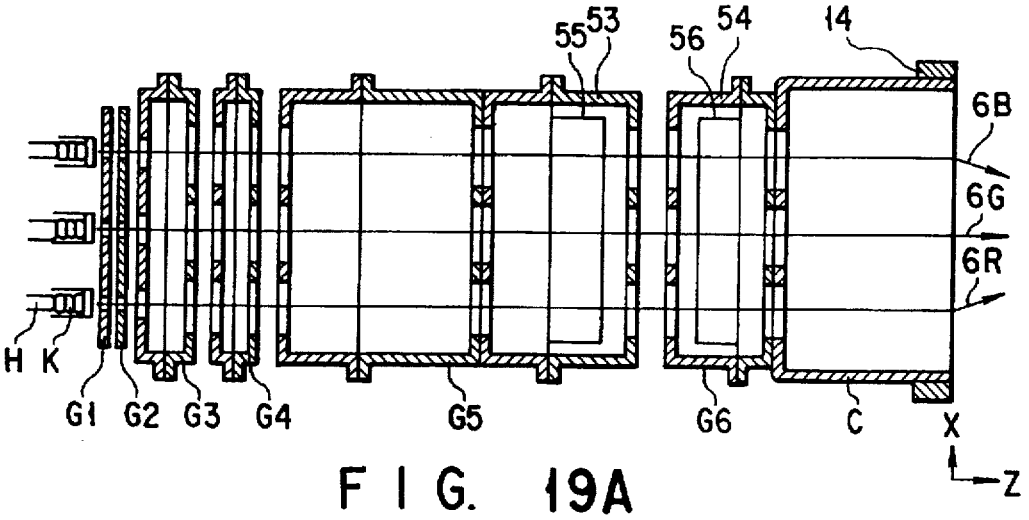
FIGS. 19A and 19B are horizontal and vertical sectional views showing the structure of the electron gun assembly shown in FIG. 18.
Figure 19B:
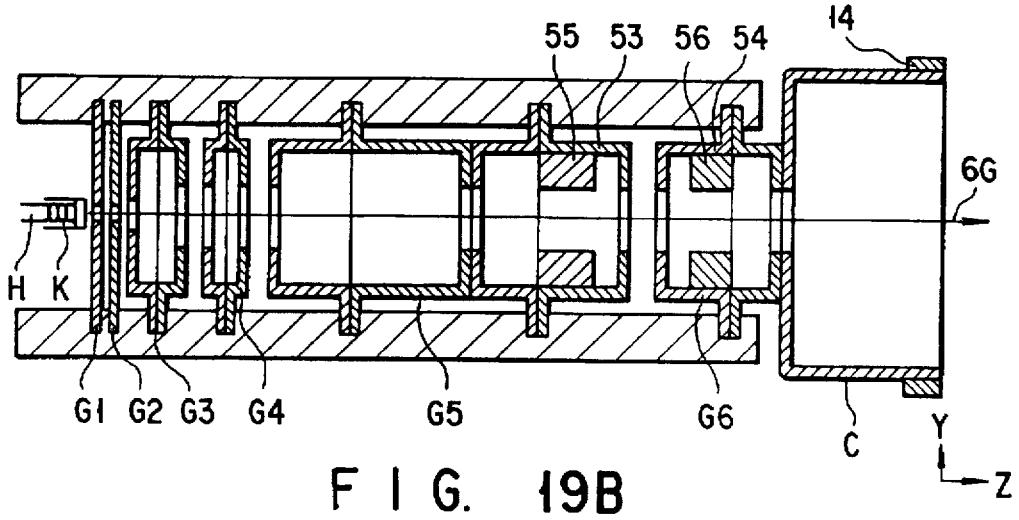

An electron gun assembly according to Embodiment 6 is shown in FIGS. 19A and 19B. This electron gun assembly has three cathodes K horizontally arranged in a line, three heaters H for respectively heating the cathodes K, first and second grids $G_1$ and $G_2$ each constituted by a plate electrode, third to sixth grids $G_3$ to $G_6$ each constituted by a cylindrical electrode obtained by combining cup electrodes to each other, and a convergence cup C arranged to the sixth grid $G_6$. These grids are sequentially arranged at predetermined intervals in a direction from the cathodes K to a phosphor screen. A permanent magnet 14 for forming a common magnetic quadrupole lens is arranged on the outer surface of the convergence cup C.

Three electron beam through holes are coaxially formed in each of the grids $G_1$ to $G_6$ and the convergence cup C with respect to the cathodes K, as in the electron gun assembly of Embodiment 1 in FIGS. 2A and 2B. However, in the electron gun assembly according to Embodiment 6, especially, unlike the electron of each of the above embodiments, the fifth grid $G_5$ is constituted by one cylindrical electrode obtained by combining four cup electrodes to each other, and pairs of plate auxiliary electrodes 55 and 56 are formed inside a cup electrode 53 of the fifth grid $G_5$ on the sixth grid $G_6$ side and inside a cup electrode 54 of the sixth grid $G_6$ on the fifth grid $G_5$ side, respectively. The three beam through-holes of an in-line arrangement formed in the cup electrode 53 are interposed by the pair of auxiliary electrodes 55, and the three beam through holes of an in-line arrangement horizontally formed in the cup electrode 54 are interposed by the pair of auxiliary electrodes 56. In the electron gun assembly, since main electron lenses are formed by the fifth and sixth grids $G_5$ and $G_6$, the pairs of auxiliary electrodes 55 and 56 are arranged for the main electron lenses. The application of the pairs of auxiliary electrodes 55 and 56 to the main electron lenses is described in Published Examined Japanese Patent Application Nos. 60-7345, 1-236554, or the like.

In the electron gun assembly, three electron beams 6B, 6G, and 6R parallelly travel until the electron beams are incident on a common magnetic quadrupole lens formed by the permanent magnet 14, and the three electron beams 6B, 6G, and 6R are converged on the phosphor screen by the common magnetic quadrupole lens. In this case, the pairs of auxiliary electrodes 55 and 56 respectively arranged to the fifth and sixth grids $G_5$ and $G_6$ correct the distortion of the shape of a beam spot on the phosphor screen caused by the converging function of the common magnetic quadrupole lens.

The main electron lenses of the electron gun assembly arranged as described above have a focusing function as a whole. However, at the same time, by electric fields formed by the pairs of auxiliary electrodes 55 and 56, the three electron beams 6B, 6G, and 6R are relatively diverged in the arrangement direction of the three electron beams 6B, 6G, and 6R, and the three electron beams 6B, 6G, and 6R are relatively focused in the direction perpendicular to the arrangement direction of the three electron beams 6B, 6G, and 6R. Therefore, the main electron lenses have the functions of polarities opposite to the focusing function of the common magnetic quadrupole lens in the arrangement direction of the three electron beams 6B, 6G, and 6R and the diverging function of the common magnetic quadrupole lens in the direction perpendicular to the arrangement direction.

Figure 20:
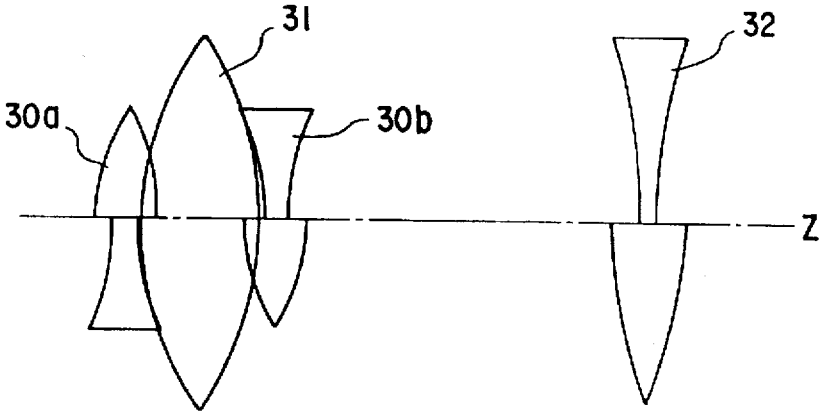
FIG. 20 is a view showing the optical model for explaining a relationship between a main electron lens and a magnetic quadrupole lens of the electron gun assembly shown in FIG. 19.

In the electron gun assembly, as shown in FIG. 20 as an optical model using the lower side as the horizontal direction with respect to the tube axis as the boundary and using the upper side as the vertical direction, a first individual electric quadrupole lens 30*a* mainly having a diverging function in the horizontal direction and a focusing function in the vertical direction is formed at the front portion (cathode side) of a main electron lens 31 by the auxiliary electrodes 55, and a second individual electric quadrupole lens 30*b* mainly having a focusing function in the horizontal direction and a diverging function in the vertical direction is formed at the rear portion (phosphor screen side) of the main electron lens 31 by the auxiliary electrodes 56.

When the electron lens is used, the horizontal and vertical focusing forces of the first and second individual electric quadrupole lenses 30*a* and 30*b* are set to be equal to each other in the absence of a common magnetic quadrupole lens 32. In contrast to this, when the common magnetic quadrupole lens 32 is present, the lens function of the first individual electric quadrupole lens 30*a* is enhanced, and the three electron beams 6B, 6G, and 6R are relatively diverged in the arrangement direction of the three electron beams as a whole and relatively focused in the direction perpendicular to the arrangement direction of the three electron beams as a whole. For this reason, the sizes of beam spots on the phosphor screen can be decreased, and the beam spots having preferable shapes can be obtained. In addition, dynamic focusing which changes the voltage of the fifth grid $G_5$ in accordance with a scanning function performed from the central portion of the screen to the peripheral portion thereof can be efficiently performed.

Note that a multipole magnet for correcting the offset of electron beam paths which occurs in assembling the electron gun assembly and the color cathode ray tube may be arbitrarily arranged in the color cathode ray tube having this electron gun assembly.

(Embodiment 7)

Figure 21:
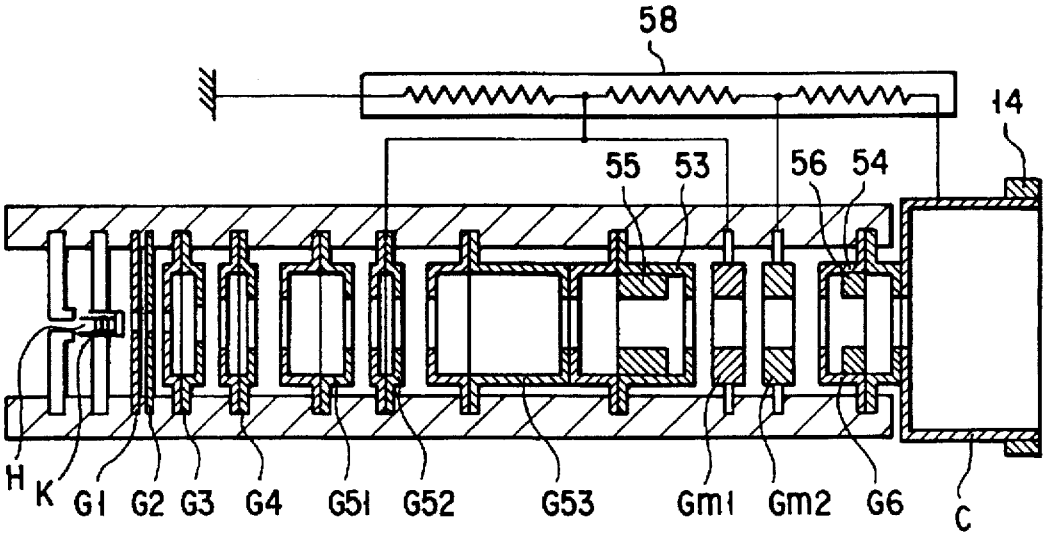
FIG. 21 is a vertical sectional view showing the structure of an electron gun assembly according to Embodiment 7 of the present invention.
Figure 22:
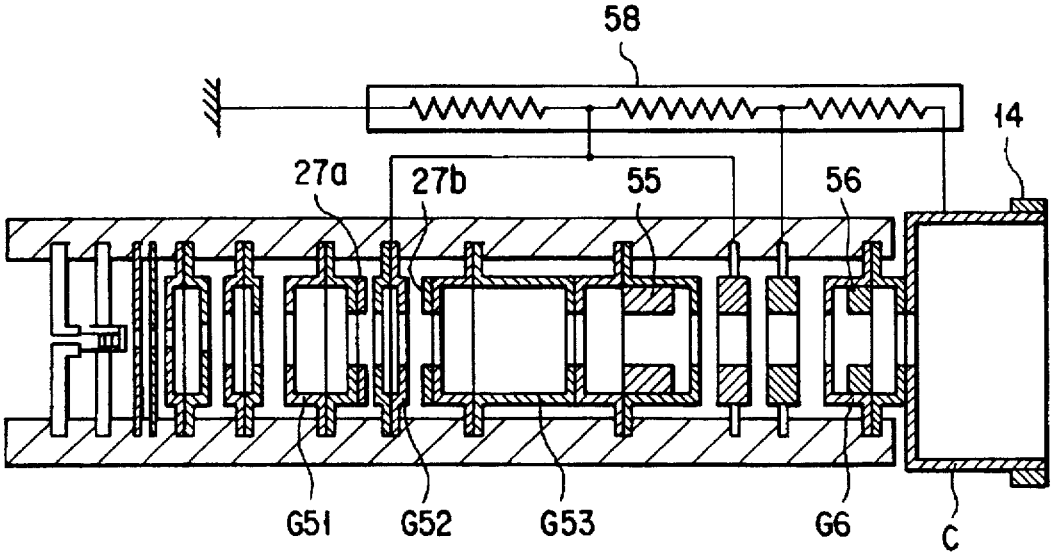
FIG. 22 is a vertical sectional view showing the structure of an electron gun assembly according to a modification of the embodiment shown in FIG. 21.
Figure 23:
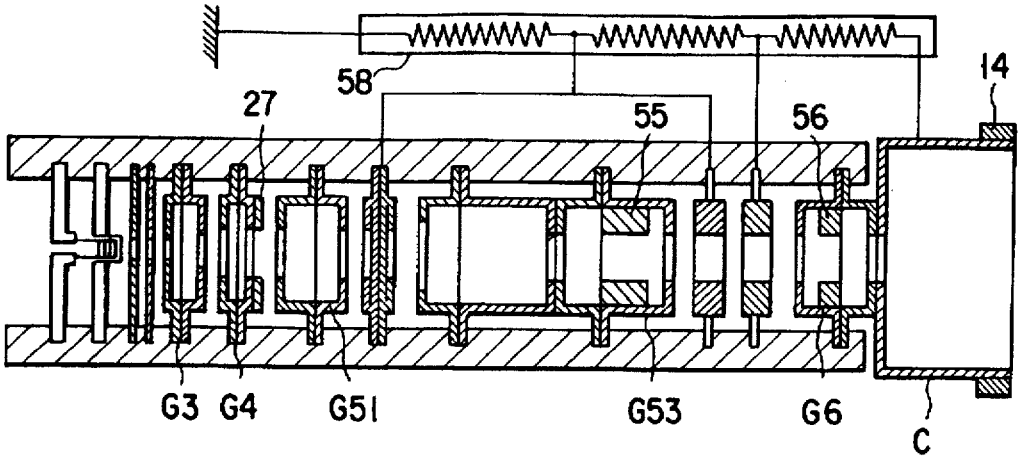
FIG. 23 is a vertical sectional view showing the structure of an electron gun assembly according to another modification of the embodiment shown in FIG. 21.

Three types of electron gun assemblies according to Embodiment 7 are shown in FIGS. 21, 22, and 23.

The electron gun assembly shown in FIG. 21 has three cathodes K horizontally arranged in a line, three heaters H for respectively heating the cathodes K, first and second grids $G_1$ and $G_2$ each constituted by a plate electrode, third, fourth, fifth, and sixth grids $G_3$, $G_4$, $G_{51}$, $G_{52}$, $G_{53}$ and $G_6$ each constituted by a cylindrical electrode obtained by combining cup electrodes to each other, intermediate electrodes $G_{m1}$ and $G_{m2}$ arranged between the fifth grid $G_{53}$ and the sixth grid $G_6$ and each constituted by a plate electrode, and a convergence cup C arranged adjacent to the sixth grid $G_6$. These grids are sequentially arranged at predetermined intervals in a direction from the cathodes K to a phosphor screen. A permanent magnet 14 for forming a common magnetic quadrupole lens is arranged on the outer surface of the convergence cup C. Auxiliary electrodes 55 and 56 described in Embodiment 6 are arranged inside a cup electrode 53 of the fifth grid $G_{53}$ on the intermediate electrode $G_{m1}$ side and inside a cup electrode 52 of the sixth grid $G_6$ on the intermediate electrode $G_{m2}$ side, respectively.

In this electron gun assembly, main electron lenses formed between the fifth and sixth grids are enlarged by insertion of the intermediate electrodes $G_{m1}$ and $G_{m2}$, a first individual electric quadrupole lens is arranged at the front portion of each of the enlarged main electron lenses, and a second individual electric quadrupole lens is arranged at the rear portion of each of the enlarged main electron lenses, thereby changing the balance between the first and second individual electric quadrupole lenses.

In FIG. 21, reference numeral 58 denotes a resistor for dividing an anode voltage applied to the sixth grid $G_6$ through the convergence cup C to apply predetermined voltages to the fifth grid $G_{52}$ and the intermediate electrodes $G_{m1}$ and $G_{m2}$.

The electron gun assembly shown in FIG. 22 has the following structure. That is, in the electron gun assembly having the structure shown in FIG. 21, a pair of parallel-plate electrodes 27*a* are arranged on the end face of the fifth grid $G_{51}$ on the fifth grid $G_{52}$ side, a pair of parallel-plate electrodes 27*b* are arranged on the end face of the fifth grid $G_{53}$ on the fifth grid $G_{52}$ side, and individual electric quadrupole lenses are formed between the fifth grids $G_{51}$ and $G_{53}$ by the parallel-plate electrodes 27*a* and 27*b*.

Figure 24:
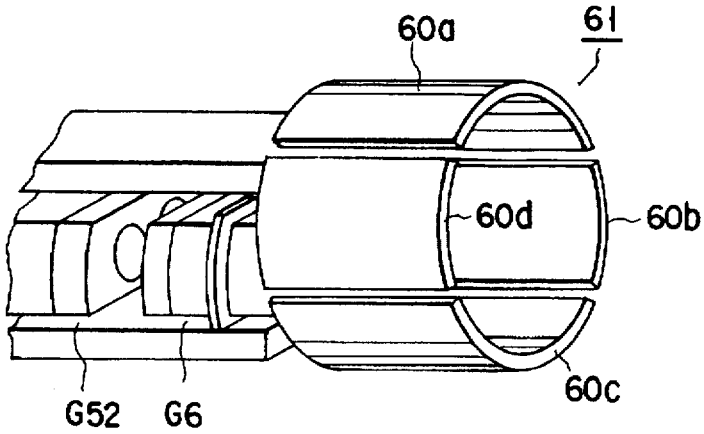
FIG. 24 is a partially cutaway perspective view showing the structure of an electron gun assembly according to Embodiment 9 of the present invention.

The electron gun assembly shown in FIG. 24 has the following structure. That is, in the electron gun assembly having the structure shown in FIG. 21, a pair of parallel-plate electrodes 27 are arranged on the end face of the fourth grid $G_4$ on the fifth grid $G_{51}$ side, and individual electric quadrupole lenses are formed between the third grid $G_3$ and the fifth grid $G_{51}$ by the parallel-plate electrodes 27.

In each of the electron gun assemblies, each of the formed individual electric quadrupole lenses (all the first and second individual electric quadrupole lenses in the electron gun assembly shown in FIG. 15) has a lens function of a polarity opposite to that of the common magnetic quadrupole lens formed by the permanent magnet 14 arranged on the outer surface of the convergence cup C. For this reason, the sizes of beam spots on the phosphor screen can be decreased, and the beam spots having preferable shapes can be obtained.

The electrode formation for forming the above individual electric quadrupole lenses is not limited to the above three types of electron gun assemblies, and various arrangements of the electrode formation can be effected.

In each of the electron gun assemblies having the structures shown in FIGS. 22 and 23, individual electric quadrupole lenses need not be formed between the fifth grid $G_{53}$ and the sixth grid $G_6$.

(Embodiment 8)

In each of Embodiments 1 to 7, although the common magnetic quadrupole lens is formed by the annular permanent magnet having an almost rectangular section, the permanent magnet may have a circular section which is effective to obtain a high breakdown voltage. In addition, the permanent magnet may be formed on not only the outer surface of the convergence cup but the inner surface thereof. The permanent magnet may be formed on not only a cup electrode having a circular section but a cup electrode having an almost rectangular section such that the permanent magnet conforms to the shape of the outer or inner surface of the cup electrode. Although the permanent magnet is arranged in the color cathode ray tube, the permanent magnet may be arranged outside the tube, or the permanent magnet may be incorporated in a deflection apparatus. In this case, the permanent magnet is preferably arranged on the phosphor screen side with respect to the main electron lenses of the electron gun assembly and on the cathode side with respect to the deflection center of the deflection apparatus.

The individual electric quadrupole lenses are not limited to the individual electric quadrupole lenses used in each of the above embodiments. Any individual electric quadrupole lenses which relatively diverge three electron beams in the arrangement direction of the three electron beams and relatively focus the three electron beams in the direction perpendicular to the arrangement direction can be used. The positions at which the individual electric quadrupole lenses are arranged are not limited to the positions described in the above embodiments.

(Embodiment 9)

In each of the above embodiments, a case wherein three electron beams of an in-line arrangement are focused by a common magnetic quadrupole lens formed by a permanent magnet has been described. However, the three electron beams can be focused by an electric quadrupole lens commonly used for the three electron beams.

Figure 25:
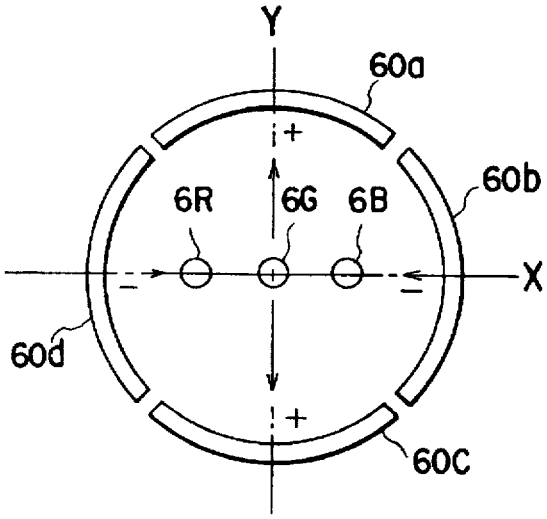
FIG. 25 is a view showing the four-divided electrodes of the electron gun assembly shown in FIG. 24.

An electron gun assembly shown in FIG. 25 is an electron gun assembly using the electric quadrupole lens. This electron gun assembly, as in the electron gun assembly of Embodiment 1 shown in FIGS. 2A and 2B, three cathodes horizontally arranged in a line, three heaters for respectively heating these cathodes, first to sixth grids (only the fifth and sixth grids $G_{52}$ and $G_6$ are shown in FIG. 24) sequentially arranged at predetermined intervals in a direction from the cathodes to a phosphor screen, a pair of parallel-plate electrodes arranged on the fifth grids $G_{52}$, and an electrode 61. The electrode 61 is arranged on the sixth grid $G_6$ on the phosphor screen side, and as shown in FIG. 24, has a shape obtained such that a cylinder is divided into four parts formed by electrode pieces **60*b* and 60*d* symmetrically arranged to be opposite each other in the horizontal direction, i.e., the arrangement direction of three electron beams 6B, 6G, and 6R, and electrode pieces 60*a* and 60*c* symmetrically arranged to be apposite to each other in the vertical direction perpendicular to the arrangement direction of the three electron beams 6B, 6G, and 6R**.

In the electrode pieces **60*a*, 60*b*, 60*c*, and 60*d* of the electrode 61, as represented by "+" and "−" in FIG. 25, voltages higher than those applied to the horizontally arranged electrode pieces 60*b* and 60*d* are applied to the vertically arranged electrode pieces 60*a* and 60*c***. The voltages are applied by the following method. That is, a resistor (not shown) is arranged in a tube, and an anode voltage applied to the sixth grid $G_6$ is divided by the resistor, so that the divided voltages are applied to the electrode pieces, respectively.

When the electron gun assembly is arranged as described above, the three electron beams 6B, 6G, and 6R are focused in the arrangement direction thereof by the electrode pieces **60*a*, 60*b*, 60*c*, and 60*d*, and an electric quadrupole lens (to be referred to as a common electric quadrupole lens hereinafter), commonly acting on the three electron beams 6B, 6G, and 6R diverging in the direction perpendicular to the arrangement direction is formed. For this reason, the common electric quadrupole lens, similar to the common magnetic quadrupole lens described in each of the above embodiments, can preferably focus and converge the three electron beams 6B, 6G, and 6R on the phosphor screen. When the three parallel electron beams 6B, 6G, and 6R** are converged by the common electric quadrupole lens, unlike in use of the common magnetic quadrupole lens, an expensive magnetic member is not required, and the magnetic member need not be magnetized, thereby simplifying the steps in manufacturing a color cathode ray tube. In addition, when the common magnetic quadrupole lens is used, the disturbance of the magnetic field of a deflection apparatus, caused by a magnetic field for forming the quadrupole lens, convergence of the three electron beams, and an influence of raster disturbance must be considered. However, when common electric quadrupole lens is used, the above consideration is not required.

There is provided a color cathode ray tube including an electron gun assembly having three cathodes of an in-line arrangement and a plurality of electrodes for controlling electrons emitted from the three cathodes, focusing the emitted electrons to form three electron beams of an in-line arrangement, and forming a plurality of electron lenses including main electron lenses. The electron lenses focus the three electron beams on the phosphor screen. A magnet for generating a magnetic quadrupole lens or electrodes for forming an electric quadrupole lens, which commonly acts on the three electron beams in a converging direction of the electron beams, are arranged near the electron gun assembly. The electrodes for forming electric quadrupole lenses have a lens function of a property opposite to that of the magnetic or electric quadrupole lens and respectively acting on the three electron beams are arranged in the electron gun assembly. In this case, the electric quadrupole lenses respectively acting on the three electron beams converge the three electron beams in a given direction and diverge the three electron beams in the direction perpendicular to the given direction, and the aberrations of the lenses in the converging direction are small. For this reason, when the two types of quadrupole lenses having opposite polarities are formed as described above to decrease both of the aberration of the lens in a given direction and the aberration of the lens in the direction perpendicular to the given direction, the sizes of beam spots on the phosphor screen can be decreased, and the beam spots having preferable shapes can be obtained.

When the electron gun assembly is arranged as described above, electron beam through holes of each electrode can be coaxially formed, so that the electron gun assembly can be easily assembled at high accuracy.

Since a variation in convergence of the three electron beams caused by a change in focus voltage can be eliminated, the convergence of the three electron beams in the color cathode ray tube can be easily adjusted. In addition, when the lens powers of electric quadrupole lenses respectively acting on the three electron beams are changed in accordance with scanning of the screen from its center portion to its peripheral portion, an effect of easily performing dynamic focusing and the like can be obtained.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A color cathode ray tube apparatus comprising:

beam generating means for generating three electron beams;

emitting means for emitting light rays, said emitting means having a center region and a peripheral region; and deflecting means for deflecting the three electron beams generated by said generating means in a horizontal and a vertical direction, said emitting means being scanned by the deflected electron beams, said deflecting means producing an astigmatism lens only when the electron beams are deflected to the peripheral region of the emitting means, the astigmatism lens having a distortion power for distorting the electron beams, the distorting power being changed depending on the deflection of the electron beams, said beam generating means including:

three cathodes, of an in-line arrangement, for respectively emitting a center electron beam and side electron beams, and an electron lens system for correcting the distortion power of the astigmatism lens by converging the center electron beam and side electron beams on said emitting means and for focusing each of the electron beams, said electron lens system including:

individual electron lenses having a first lens power in a horizontal plane defined by said horizontal direction and a tube axis, and a second lens power different from the first lens power in a vertical plane defined by said vertical direction and the tube axis, magnitudes of the first and second lens powers being changed in accordance with the deflection of the electron beams, the first lens power having a divergent lens power when electron beams are directed to the center region of the emitting means and a convergent lens power when electron beams are directed to the peripheral region of the emitting means, the second lens power having a convergent lens power when the electron beams are directed to the center region of the emitting means and a divergent lens power when the electron beams are directed to the peripheral region of the emitting means, main electron lenses provided for the respective electron beams, each main electron lens having a main electron lens power for focusing an incident one of the three electron beams on said emitting means, and a common electron lens for correcting the distortion power of the astigmatism lens, the common electron lens having a third lens power in the horizontal plane and a fourth lens power different from the third lens power in the vertical plane, the three electron beams being focused on said emitting means in the horizontal plane by the first lens power, the third lens power and said main electron lens power, the three electron beams being focused on said emitting means in the vertical plane by the second lens power, the fourth lens power and said main electron lens power.

2. An apparatus according to claim 1, wherein said common electron lens includes a magnetic quadrupole lens, having four magnetic poles, for applying a magnetic field to the three electron beams to converge the three electron beams on said emitting means.

3. An apparatus according to claim 1, wherein said common electron lens acting on the three electron beams is a quadrupole lens having different functions for the center beam and the side beams.

4. A color cathode ray tube apparatus comprising:

beam generating means for generating three electron beams;

emitting means for emitting light rays, said emitting means having a center region and a peripheral region; and deflecting means for deflecting the three electron beams generated by said generating means in a horizontal and a vertical direction, said emitting means being scanned by the deflected electron beams, said deflecting means producing an astigmatism lens only when the electron beams are deflected to the peripheral region of the emitting means, the astigmatism lens having a distortion power for distorting the electron beams, the distorting power being changed depending on the deflection of the electron beams, said beam generating means including:

three cathodes, of an in-line arrangement, for respectively emitting a center electron beam and side electron beams, and an electron lens system for correcting the distortion power of the astigmatism lens by converging the center electron beam and side electron beams on the emitting means and for focusing each of the electron beams, said electron lens system including:

individual electron lenses having a first lens power in a horizontal plane defined by said horizontal direction and a tube axis, and a second lens power different from the first lens power in a vertical plane defined by said vertical direction and the tube axis, magnitudes of the first and second lens powers being changed in accordance with the deflection of the electron beams, the first lens power having a divergent lens power when electron beams are directed to the center region of the emitting means and a convergent lens power when the electron beams are directed to the peripheral region of the emitting means, the second lens power having a convergent lens power when the electron beams are directed to the center region of the emitting means and a divergent lens power when the electron beams are directed to the peripheral region, main electron lenses provided for the respective electron beams, each main electron lens having a main electron lens power for focusing an incident one of the three electron beams on said emitting means, and a common electron lens for correcting the distortion power of the astigmatism lens, the common electron lens having a third lens power in the horizontal plane and a fourth lens power different from the third fens power in the vertical plane, the three electron beams being focused on said emitting means in the horizontal plane by the first lens power, the third lens power and said main electron lens power, the three electron beams being focused on said emitting means in the vertical plane by the second lens power, the fourth lens power and said main electron lens power, the common electron lens being formed between the main electron lenses and the deflecting means.

5. An apparatus according to claim 4, wherein said common electron lens includes a magnetic quadrupole lens having four magnetic poles for applying a magnetic field to the three electron beams so that the three electron beams converge on said emitting means.

6. A color cathode ray tube apparatus comprising:

beam generating means for generating three electron beams;

emitting means for emitting light rays, said emitting means having a center region and a peripheral region; and deflecting means for deflecting the three electron beams from said generating means in a horizontal and a vertical direction, said emitting means being scanned by the deflected electron beams, said deflecting means producing an astigmatism lens only when the electron beams are deflected to the peripheral region of the emitting means, the astigmatism lens having a distortion power for distorting the electron beams, the distorting power being changed depending on the deflection of the electron beams, said beam generating means including:

three cathodes, of an in-line arrangement, for respectively emitting a center electron beam and side electron beams, and an electron lens system for correcting the distortion power of the astigmatism lens by converging the center electron beam and side electron beams on the emitting means and for focusing each of the electron beams, said electron lens system including:

individual electron lenses having a first lens power in a horizontal plane defined by said horizontal direction and a tube axis, and a second lens power different from the first lens power in a vertical plane defined by said vertical direction and the tube axis, magnitudes of the first and second lens powers being changed in accordance with the deflection of the electron beams, the first lens power having a divergent lens power when electron beams are directed to the center region of the emitting means and a convergent lens power when the electron beams are directed to the peripheral region of the emitting means, the second lens power having a convergent lens power when the electron beams are directed to the center region of the emitting means and a divergent lens power when the electron beams are directed to the peripheral region of the emitting means, and a common electron lens for correcting the distortion power of the astigmatism lens, the common electron lens having a third lens power in the horizontal plane and a fourth lens power different from the third lens power in the vertical plane, the three electron beams being focused on said emitting means in the horizontal plane by the first lens power and the third lens power, the three electron beams being focused on said emitting means in the vertical plane by the second lens power and the fourth lens power, wherein the individual electron lenses and the common lens are quadrupole lenses.

7. An apparatus according to claim 6, wherein said common electron lens includes a magnetic quadrupole lens having four magnetic poles for applying a magnetic field to the three electron beams so that the three electron beams converge on said emitting means.

8. A color cathode ray tube apparatus as recited in claim 6, where the electron lens system further includes:

main electron lenses provided for the respective electron beams, each main electron lens having a main electron lens power for focusing an incident one of the three electron beams on said emitting means, where the three electron beams are focused on the emitting means in the horizontal plane by the first lens power, the third lens power and the main electron lens power, and where the three electron beams are focused on the emitting means in the vertical plane by the second lens power, the fourth lens power and the main electron lens power.

* * * * *